US009506674B2

(12) United States Patent
Morimoto et al.

(10) Patent No.: US 9,506,674 B2
(45) Date of Patent: Nov. 29, 2016

(54) AIR CONDITIONER INCLUDING A BYPASS PIPELINE FOR A DEFROSTING OPERATION

(75) Inventors: Osamu Morimoto, Tokyo (JP); Makoto Saito, Tokyo (JP); Satoru Yanachi, Tokyo (JP); Koji Yamashita, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 997 days.

(21) Appl. No.: 13/132,092

(22) PCT Filed: Jan. 15, 2009

(86) PCT No.: PCT/JP2009/050412
§ 371 (c)(1),
(2), (4) Date: Jun. 1, 2011

(87) PCT Pub. No.: WO2010/082325
PCT Pub. Date: Jul. 22, 2010

(65) Prior Publication Data

US 2011/0232308 A1 Sep. 29, 2011

(51) Int. Cl.
*F25B 41/00* (2006.01)
*F25D 21/00* (2006.01)
(Continued)

(52) U.S. Cl.
CPC ..... *F25B 13/00* (2013.01); *F25B 47/022* (2013.01); *F25B 2313/006* (2013.01);
(Continued)

(58) Field of Classification Search
CPC .... F25B 47/02; F25B 47/022; F25B 47/025; F25B 2347/02; F25B 2347/19; F25B 2313/023; F25B 2313/0232; F25B 2313/02322; F25B 2313/24; F25B 2313/04; F25B 2313/0409; F25B 2323/0232; F25B 2323/02322; F25B 2323/02323; F25B 2323/0252; F25B 2323/02522; F25B 2323/02523; F25B 2313/025; F25B 2313/0251; F25B 2313/0252; F25B 2313/02522; F25B 2313/02523; F25B 2313/02323; F25B 2313/0253
USPC ..... 62/196.1, 196.4, 272, 278, 324.1, 62/324.5, 324.6, 150, 151, 152, 155, 81
See application file for complete search history.

(56) References Cited

U.S. PATENT DOCUMENTS 4,576,011 A * 3/1986 Glamm et al. ..... 62/115
4,770,000 A * 9/1988 Kuroda et al. ..... 62/156
(Continued)

FOREIGN PATENT DOCUMENTS

CA 2358972 A1 * 4/2002 ..... F25B 13/00
JP 60-233471 A 11/1985
(Continued)

OTHER PUBLICATIONS

Japanese Office Action (Reasons for Rejection) dated Mar. 4, 2014, issued by the Japanese Patent Office in corresponding Japanese Patent Application No. 2010-546507, and English language translation of Office Action. (5 pages).
(Continued)

*Primary Examiner* — Marc Norman
*Assistant Examiner* — Daniel C Comings
(74) *Attorney, Agent, or Firm* — Buchanan Ingersoll & Rooney PC

(57) ABSTRACT

An air conditioner that can perform defrosting efficiently while heating or the like is continued even if the air conditioner is configured by one outdoor unit is obtained. In an air conditioner in which an outdoor unit having a compressor that pressurizes and discharges a refrigerant, a plurality of outdoor heat exchangers that exchange heat between outside air and the refrigerant, and a four-way valve that switches a channel on the basis of an operation form and a plurality of indoor units, each having an indoor heat exchanger that exchanges heat between the air in a space to be air-conditioned and the refrigerant and an indoor throttle device are connected by a pipeline so as to configure a refrigerant circuit, a bypass pipeline that divides the refrigerant discharged from the compressor so as to allow the refrigerant to flow into each of the outdoor heat exchangers connected in parallel by a pipeline, a plurality of outdoor third opening/closing valves that pass or shut off the refrigerant from the bypass pipeline to each of the outdoor heat exchangers, and a plurality of outdoor second opening/closing valves that pass or shut off the refrigerant from the indoor unit to each of the outdoor heat exchangers are disposed in the outdoor unit.

6 Claims, 12 Drawing Sheets

(51) Int. Cl.

| | |
|---|---|
| ***F25D 21/06*** | (2006.01) |
| ***F25B 49/00*** | (2006.01) |
| ***F25B 47/00*** | (2006.01) |
| ***F25B 13/00*** | (2006.01) |
| *F25B 47/02* | (2006.01) |

(52) U.S. Cl.

CPC . *F25B 2313/025* (2013.01); *F25B 2313/0211* (2013.01); *F25B 2313/0232* (2013.01); *F25B 2313/0233* (2013.01); *F25B 2313/0251* (2013.01); *F25B 2313/0253* (2013.01); *F25B 2313/0272* (2013.01); *F25B 2313/02322* (2013.01); *F25B 2313/02323* (2013.01); *F25B 2313/02522* (2013.01); *F25B 2313/02741* (2013.01); *F25B 2400/13* (2013.01)

(56) References Cited

U.S. PATENT DOCUMENTS

| | | | | |
|---|---|---|---|---|
| 5,159,817 | A * | 11/1992 | Hojo et al. | 62/81 |
| 5,709,097 | A * | 1/1998 | Kim et al. | 62/206 |
| 6,035,658 | A * | 3/2000 | Launois | B60H 1/00907 62/196.4 |
| 7,628,027 | B2 * | 12/2009 | Shapiro | 62/228.1 |
| 2005/0257558 | A1 * | 11/2005 | Yoshioka et al. | 62/324.5 |
| 2008/0092572 | A1 * | 4/2008 | Kim | 62/160 |

FOREIGN PATENT DOCUMENTS

| | | | |
|---|---|---|---|
| JP | 01-247972 | A | 10/1989 |
| JP | 4-110576 | A | 4/1992 |
| JP | 5-215437 | A | 8/1993 |
| JP | 6-257902 | A | 9/1994 |
| JP | 9-119754 | A | 5/1997 |
| JP | 11-337234 | A | 12/1999 |
| JP | 2004-309088 | A | 11/2004 |
| JP | 2004-347164 | A | 12/2004 |
| JP | 2005-233451 | A | 9/2005 |
| JP | 2007-271094 | A | 10/2007 |
| KR | 2004-0034139 | A | 4/2004 |

OTHER PUBLICATIONS

Office Action (Notice of Reasons for Rejection) dated Aug. 14, 2012, issued in corresponding Japanese Patent Application No. 2010-546507, and an English Translation thereof. (3 pages).

Office Action (Decision of Refusal) dated Feb. 26, 2013, issued in corresponding Japanese Patent Application No. 2010-546507, and an English Translation thereof. (4 pages).

Chinese Office Action dated Feb. 27, 2013, issued in corresponding Chinese Patent Application No. 200980153882.2 and English translation. (10 pages).

Chinese Office Action dated Oct. 24, 2013, issued by the Chinese Patent Office in corresponding Chinese Patent Application No. 200980153882.2, and English language translation of Office Action. (10 pages).

International Search Report (PCT/ISA/210) issued on Apr. 7, 2009, by Japanese Patent Office as the International Searching Authority for International Application No. PCT/JP2009/050412.

Office Action issued on Apr. 18, 2014, by the Chinese Patent Office in corresponding Chinese Patent Application No. 200980153882.2, and an English Translation of the Office Action. (5 pages).

Office Action (Appeal Decision of Rejection) issued on Jul. 1, 2014, by the Japanese Patent Office in corresponding Japanese Patent Application No. 2013-008926 and an English translation of the Office Action. (30 pages).

* cited by examiner

AIR CONDITIONER INCLUDING A BYPASS PIPELINE FOR A DEFROSTING OPERATION

TECHNICAL FIELD

The present invention relates to an air conditioner of an electric heat pump that performs a cooling/heating operation using a refrigerating cycle (heat pump cycle) for air conditioning. The present invention particularly relates to an air conditioner that can perform defrosting of an outdoor unit efficiently while continuing heating or the like in an indoor unit.

BACKGROUND ART

In an air conditioner, one or a plurality of outdoor units (heat-source side units), each having a compressor and an outdoor heat exchanger (heat-source side heat exchanger), and one or a plurality of indoor units (load-side units), each having a throttle device so as to become an expansion valve and an indoor heat exchanger (load-side heat exchanger), are connected by a pipeline. A space to be air-conditioned is cooled/heated by configuring a refrigerant circuit so as to circulate a refrigerant.

When the outdoor unit is performing a heating operation, for example, a low-temperature refrigerant passes through a pipeline in the outdoor heat exchanger which becomes an evaporator, and heat exchange is performed between the refrigerant and air through the pipeline, and thus, moisture in the air is condensed in a fin or in a heat transfer pipe and forms frost. If the frost accumulates (frost formation), the heat exchange with air cannot performed well, and a heating capacity (a heat amount per time to be supplied to the indoor unit side (hereinafter, this capacity also including a cooling capacity is referred to as capacity)) in the outdoor unit deteriorates, and the capacity cannot be exerted for an air-conditioning load (a heat amount required by the indoor unit (hereinafter, referred to as a load)) in the indoor unit. Then, in order to remove the frost formed on the heat-source side heat exchanger during heating, for example, a defrosting operation (defrosting) is performed for each outdoor unit (See Patent Document 1, for example). At this time, the defrosting operation is performed in any one of the outdoor units, while the heating operation is continued in the other outdoor units.

For example, in the outdoor unit that performs the defrosting operation, a four-way valve is switched so that a hot gas (a high-temperature gas refrigerant) from the compressor directly flows into the outdoor heat exchanger. Through heat exchange between the hot gas and the frost, the frost is melted, and the hot gas is partially liquefied and brought into a gas-liquid two-phase refrigerant. This gas-liquid two-phase refrigerant and the high-temperature gas refrigerant coming out of the outdoor unit that continues the heating operation are combined, the high-temperature two-phase refrigerant flows to the indoor unit side, and cooling/heating is performed.

Patent Document 1: Japanese Unexamined Patent Application Publication No. 2007-271094

DISCLOSURE OF INVENTION

Problems to be Solved by the Invention

As described above, if the defrosting operation is performed while heating or the like is continued in an indoor unit in a prior-art air conditioner, there should be two or more outdoor units. Thus, a cost of the entire air conditioner is raised. Also, a large installation space for disposing two or more outdoor unites is required.

On the other hand, if there is only one outdoor unit, the defrosting operation cannot be performed while heating or the like by the indoor unit is continued. Therefore, heating by the indoor unit is stopped during the defrosting operation. Thus, a room temperature might become out of a set temperature during the defrosting operation, for example. Also, even if the operation of heating or the like is resumed after the defrosting operation, air at a high temperature cannot be blown out immediately from the indoor unit.

Thus, the present invention has an object to obtain an air conditioner that can perform a defrosting operation efficiently while continuing a heating operation or the like even if the outdoor unit is formed by one unit.

Means for Solving the Problems

An air conditioner according to the present invention is an air conditioner composed of an outdoor unit having a compressor that pressurizes and discharges a refrigerant, a plurality of outdoor heat exchangers that exchange heat between outside air and the refrigerant, and channel switching means that switches a channel on the basis of an operation form and a plurality of indoor units, each having an indoor heat exchanger that exchanges heat between air in a space to be air-conditioned and the refrigerant and an indoor flow controller, both being connected by a pipeline so as to constitute a refrigerant circuit, in which a bypass pipeline that divides the refrigerant discharged from the compressor and allows each to flow into each of the outdoor heat exchangers connected in parallel by a pipeline, a plurality of first opening/closing means, each allowing or not allowing the refrigerant to pass from the bypass pipeline to each outdoor heat exchanger, and a plurality of second opening/closing means, each allowing or not allowing the refrigerant to pass from the indoor unit to each outdoor heat exchanger are disposed in the outdoor unit.

Advantages

According to the present invention, since the bypass pipeline, the first opening/closing means, and the second opening/closing means are provided in the outdoor unit, switching between passage of the refrigerant from the bypass pipeline or passage of the refrigerant from the indoor unit to each of the outdoor heat exchangers can be performed by the first opening/closing means and the second opening/closing means for the plurality of outdoor heat exchangers connected in parallel by the pipeline. Thus, defrosting can be performed by allowing a high-temperature refrigerant to sequentially flow from the compressor to each of the outdoor heat exchanger through the bypass pipeline, and even if there is only one outdoor unit, the defrosting operation can be performed while a heating only operation or a heating-main operation is continued. Thus, even while the defrosting operation is being performed, a conformable room-temperature environment can be maintained without stopping cooling/heating in the indoor unit. And by providing only one outdoor unit, a cost is suppressed, and an installation space can be made smaller.

REFERENCE NUMERALS

1 compressor, 2 four-way valve, 3, 3*a*, 3*b* outdoor heat exchanger, 4 accumulator, 5*a* first check valve block, 5*b* second check valve block, 5*c* third check valve block, 5*d* fourth check valve block, 6, 6*a*, 6*b* first channel opening/closing valve, 7, 7*a*, 7*b* second channel opening/closing valve, 8, 8*a*, 8*b* bypass opening/closing valve, 9 blower, 10 bypass pipeline for defrosting, 11, 11*a*, 11*b* outdoor throttle device, 12*a*, 12*b*, 12*c* three-way valve, 13 outdoor heat exchange part, 21 gas-liquid separator, 22 first inter-refrigerant heat exchanger, 23 divided-flow-side first throttle device, 24 second inter-refrigerant heat exchanger, 25 divided-flow-side second throttle device, 26, 26*a*, 26*b*, 27, 27*a*, 27*b* divided-flow-side opening/closing valve, 31, 31*a*, 31*b* indoor throttle device, 32, 32*a*, 32*b* indoor heat exchanger, 33, 33*a*, 33*b* indoor control means, 51 outdoor unit, 52 divided-flow controller, 53, 53*a*, 53*b* indoor unit, 101 first pressure sensor, 102 second pressure sensor, 103, 103*a*, 103*b* outdoor temperature sensor, 104 outside air temperature sensor, 111 divided-flow-side first temperature sensor, 112 divided-flow-side second temperature sensor, 121, 121*a*, 121*b* indoor temperature sensor, 201 high-pressure pipe, 202, 205 low-pressure pipe, 203, 203*a*, 203*b*, 207, 207*a*, 207*b* liquid pipe, 204, 204*a*, 204*b*, 206, 206*a*, 206*b* gas pipe, 208 divided-flow-side bypass pipeline, 300 control means, 301 control means for divided flow controller, 310 storage means

BEST MODES FOR CARRYING OUT THE INVENTION

Embodiment 1

Figure 1:
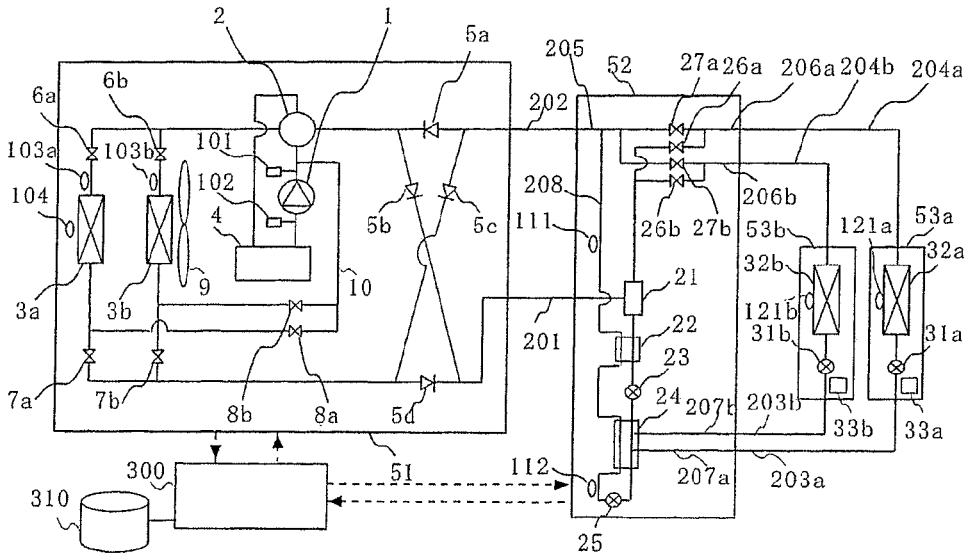
FIG. 1 is a diagram illustrating a configuration of an air conditioner and a refrigerant circuit according to Embodiment 1.

FIG. 1 is a diagram illustrating a configuration of an air conditioner according to Embodiment 1 of the present invention. First, referring to FIG. 1, means (devices) and the like constituting the air conditioner will be described. This air conditioner performs cooling/heating using a refrigerating cycle (heat pump cycle) by refrigerant circulation. In particular, the air conditioner of this embodiment is assumed to be a device capable of simultaneous cooling/heating operation (cooling/heating combined operation) in which an indoor unit performing cooling and an indoor unit performing heating can be mixed.

The air conditioner of this embodiment shown in FIG. 1 is mainly composed of an outdoor unit (heat-source machine side unit, heat source machine) 51, a plurality of indoor units (load-side units) 53*a* and 53*b*, and a divided-flow controller 52. In this embodiment, in order to control the flow of a refrigerant, the divided-flow controller 52 is disposed between the outdoor unit 51 and the indoor units 53*a* and 53*b*, and these devices are connected by various refrigerant pipelines. Also, the plurality of indoor units 53*a* and 53*b* are connected so as to be in parallel with each other. If the indoor units 53*a*, 53*b* and the like do not have to be particularly discriminated or specified, for example, suffixes such as a and b might be omitted in the following description.

As for the pipeline connection, the outdoor unit 51 and the divided-flow controller 52 are connected to each other by a high-pressure pipe 201 and low-pressure pipes 202 and 205. Here, the low-pressure pipe 205 is a pipeline disposed in the divided-flow controller. In the high-pressure pipe 201, a high-pressure refrigerant flows from the outdoor unit 51 side to the divided-flow controller 52 side. Also, in the low-pressure pipes 202 and 205, a refrigerant with a lower pressure than the refrigerant flowing through the high-pressure pipe 201 flows from the divided-flow controller 52 side to the outdoor unit 51 side. Here, determination as to whether the pressure is high or low is made on the basis of a relationship with a reference pressure (numeral value). For example, the determination is made on the basis of a relative pressure level (including intermediate) in the refrigerant circuit by pressurization of the compressor 1, control of an open/closed state (opening degree) of each throttle device (flow controller) and the like (the same applies to the following (basically, the pressure of the refrigerant discharged from the compressor 1 is the highest, and since the pressure is lowered by the flow controller and the like, the pressure of the refrigerant sucked into the compressor 1 is the lowest)).

On the other hand, the divided-flow controller 52 and the indoor unit 53*a* are connected by liquid pipes 203*a*, 207*a* and gas pipes 204*a* and 206*a*. Here, the gas pipe 206*a* and the liquid pipe 207*a* are pipelines disposed in the divided-flow controller 52. Similarly, the divided-flow controller 52 and the indoor unit 53*b* are connected by liquid pipes 203*b* and 207*b* and gas pipes 204*b* and 206*b*. Pipeline connection is composed of the low-pressure pipe 202, the high-pressure pipe 201, the liquid pipes 203 (203*a*, 203*b*), the liquid pipes 207 (207*a*, 207*b*), the gas pipes 204 (204*a*, 204*b*) and the gas pipes 206 (206*a*, 206*b*). Then, the refrigerant is circulated through the outdoor unit 51, the divided-flow controller 52, and the indoor units 53 (53*a*, 53*b*), whereby a refrigerant circuit is formed.

The compressor 1 in the outdoor unit 51 of this embodiment applies pressure and discharges (feeds) sucked refrigerant. The compressor 1 of this embodiment can arbitrarily change a driving frequency by an inverter circuit (not shown) on the basis of an instruction of control means 300. Thus, the compressor 1 is an inverter compressor that can change a discharge capacity (a discharge amount of the refrigerant per unit time) and the cooling/heating capacity with the discharge capacity.

The four-way valve 2 switches a valve in accordance with a mode of the cooling/heating operation on the basis of an instruction of the control means 300 so that a path of the refrigerant is switched. In this embodiment, the path is switched in accordance with the modes, that is, a cooling only operation (here, this refers to an operation when all the air-conditioning indoor units are performing cooling), a cooling-main operation (referring to an operation in which a cooling load is larger in the simultaneous cooling/heating operation), a heating only operation (here, this refers to an operation when all the air-conditioning indoor units are performing heating), and a heating-main operation (referring to an operation in which a heating load is larger in the simultaneous cooling/heating operation).

The outdoor heat exchangers 3 (3*a*, 3*b*) each have a heat transfer pipe through which the refrigerant passes and a fin (not shown) which increases a heat transfer area between the refrigerant flowing through the heat transfer pipe and the outside air, and exchange heat between the refrigerant and air (outside air). For example, during the heating only operation and the heating-main operation, each exchanger functions as an evaporator to evaporate and vaporize the refrigerant, for example. On the other hand, during the cooling only operation and the cooling-main operation, each exchanger functions as a condenser to condense and liquefy the refrigerant, for example. In a case, as in the cooling-main operation, for example, adjustment might be made such that the refrigerant is not fully gasified or liquefied but condensed to a two-phase mixed (gas-liquid two-phase refrigerant) state of a liquid and a gas or the like. Here, in this embodiment, performances relating to the heat exchange of the outdoor heat exchanger 3*a* and the outdoor heat exchanger 3*b* are assumed to be the same.

Also, first channel opening/closing valves 6 (6*a*, 6*b*), second channel opening/closing valves 7 (7*a*, 7*b*), and bypass opening/closing valves 8 (8*a*, 8*b*) are opened/closed on the basis of an instruction of the control means 300. For example, during a defrosting operation, either one of the second channel opening/closing valves 7*a* and 7*b* is closed, and either one of the bypass opening/closing valves 8*a* and 8*b* is opened. As a result, in the defrosting operation, for example, the refrigerant flowing from the indoor unit side is shut off so as not to flow into either one of the outdoor heat exchangers 3*a* and 3*b* in the heating only operation and the heating-main operation. The high-temperature gas refrigerant from the compressor 1 is made to directly flow through a bypass pipeline 10 for defrosting. The bypass pipeline 10 for defrosting has one end connected to a pipeline connected to the discharge side of the compressor 1. Then, one of the other ends divided in the middle is connected to a pipeline that connects the second channel opening/closing valve 7*a* and the outdoor heat exchanger 3*a*, while the other of the other ends is connected to a pipeline that connects the second channel opening/closing valve 7*b* and the outdoor heat exchanger 3*b*. The bypass opening/closing valves 8 (8*a*, 8*b*) are disposed in the bypass pipeline 10 for defrosting.

Also, a blower 9 is disposed in the vicinity of the outdoor heat exchanger 3 in order to exchange heat between the refrigerant and the outside air efficiently. The rotation speed of the blower 9 of this embodiment can be arbitrarily changed on the basis of an instruction of the control means 300. As a result, by changing an amount of the outside air to be fed, the heat exchange amount (a heat amount relating to the heat exchange) in the outdoor heat exchanger 3 can be adjusted. The blowers 9 corresponding to each of the outdoor heat exchangers 3*a* and 3*b* can be arranged individually so that a valve disposed at an inlet of the outdoor heat exchanger is closed on one side and the corresponding blower is stopped in accordance with an operation capacity of the indoor unit and the outside air temperature.

An accumulator 4 accumulates excess refrigerant in the refrigerant circuit. Also, a first check valve block 5*a* to a fourth check valve block 5*d* prevent backflow of the refrigerant, whereby the flow of the refrigerant is adjusted, and make a circulation path of the refrigerant fixed in accordance with the mode. The first check valve block 5*a* is located on the pipeline between the four-way valve 2 and the low-pressure pipe 202 and allows refrigerant communication in a direction from the low-pressure pipe 202 to the four-way valve 2. The second check valve block 5*b* is located on the pipeline between the four-way valve 2 and the high-pressure pipe 201 and allows refrigerant communication in a direction from the four-way valve 2 to the high-pressure pipe 201. The third check valve block 5*c* is located on the pipeline between the outdoor heat exchange part 13 and the low-pressure pipe 202 and allows refrigerant communication in a direction from the low-pressure pipe 202 to the outdoor heat exchanger 3. The fourth check valve block 5*d* is located on the pipeline between the outdoor heat exchange part 13 and the heat-source machine side high-pressure pipe 201 and allows refrigerant communication in a direction from the outdoor heat exchange part 13 to the high-pressure pipe 201.

Also, in this embodiment, on the pipelines connected to the discharge and suction sides of the compressor 1, a first pressure sensor 101 and a second pressure sensor 102 that detect pressures of the refrigerant relating to discharge and suction are mounted. Also, outdoor temperature sensors 103*a* and 103*b* that detect the temperatures of the refrigerants between the outdoor heat exchanger 3*a* and the four-way valve 2 and between the outdoor heat exchanger 3*b* and the four-way valve 2, respectively, are mounted. Then, an outside temperature sensor 104 that detects the temperature of the outside air (outside air temperature) is mounted. Each of the temperature sensors and the pressure sensors transmits signals relating to detection to the control means 300.

Subsequently, the divided-flow controller 52 of this embodiment will be described. A gas-liquid separator 21 disposed in the divided-flow controller 52 separates the refrigerant flowing from the high-pressure pipe 201 into a gas refrigerant and a liquid refrigerant. A gas phase part (not shown) from which the gas refrigerant flows out is connected to divided-flow-side opening/closing valves 26 (26*a*, 26*b*). On the other hand, a liquid phase part (not shown)

from which the liquid refrigerant flows out is connected to a first inter-refrigerant heat exchanger 22.

The divided-flow-side opening/closing valves 26 (26*a*, 26*b*) and 27 (27*a*, 27*b*) are opened/closed on the basis of an instruction of the control means 300. One ends of the divided-flow-side opening/closing valves 26 (26*a*, 26*b*) are connected to the gas-liquid separator 21, while the other ends are connected to the gas pipes 206 (206*a*, 206*b*), respectively. Also, the one ends of the divided-flow-side opening/closing valves 27 (27*a*, 27*b*) are connected to the gas pipes 206 (206*a*, 206*b*), respectively, while the other ends are connected to the low-pressure pipe 205. By combining the divided-flow-side opening/closing valves 26 (26*a*, 26*b*) and 27 (27*a*, 27*b*), the valves are switched so that the refrigerant flows from the indoor unit 53 side to the low-pressure pipe 202 side or from the gas-liquid separator 21 side to the indoor unit 53 side on the basis of instructions of the control means 300. Here, the flow of the refrigerant is switched by the divided-flow-side opening/closing valves 26 and 27, but a three-way valve or the like may be used, for example.

A divided-flow-side first throttle device 23 is disposed between the first inter-refrigerant heat exchanger 22 and a second inter-refrigerant heat exchanger 24 and adjusts a refrigerant flow rate flowing from the gas-liquid separator 21 and a pressure of the refrigerant by controlling an opening degree on the basis of an instruction of the control means 300. On the other hand, a divided-flow-side second throttle device 25 adjusts a refrigerant flow rate of the refrigerant passing through a divided-flow-side bypass pipeline 208 and a pressure of the refrigerant by controlling an opening degree on the basis of an instruction of the control means 300. The refrigerant having passed through the divided-flow-side second throttle device 25 passes through the divided-flow-side bypass pipeline 208, overcools the refrigerant in the second inter-refrigerant heat exchanger 24 and the first inter-refrigerant heat exchanger 22, for example, and flows into the low-pressure pipe 202.

The second inter-refrigerant heat exchanger 24 exchanges heat between the refrigerant on a downstream portion of the divided-flow-side second throttle device 25 (the refrigerant having passed through the divided-flow-side second throttle device 25) and the refrigerant flowing from the divided-flow-side first throttle device 23. Also, the first inter-refrigerant heat exchanger 22 exchanges heat between the refrigerant having passed through the second inter-refrigerant heat exchanger 24 and the liquid refrigerant flowing in a direction from the gas-liquid separator 21 to the divided-flow-side first throttle device 23.

Also, in the divided-flow controller 52, a divided-flow-side first temperature sensor 111 that detects the temperature of the refrigerant flowing through the divided-flow-side bypass pipeline 208 is mounted. Also, a divided-flow-side second temperature sensor 112 that detects the temperature of the refrigerant on a downstream portion of the divided-flow-side second throttle device 25 is mounted. Separately from the control means 300 disposed in the outdoor unit 51, control means 301 for divided-flow controller may be disposed so that processing relating to control of the divided-flow controller 52 is executed while conducting communication with the control means 300 or the like. Here, in order to facilitate explanation, description will be made under the assumption that the control means 300 executes the processing.

Subsequently, a configuration of the indoor units 53 (53*a*, 53*b*) will be described. The indoor units 53 have indoor heat exchangers 32 (32*a*, 32*b*) and indoor throttle devices 31 (31*a*, 31*b*) connected in series in proximity to the indoor heat exchangers 32. Also, in this embodiment, indoor control means 33 (33*a*, 33*b*) are provided. The indoor heat exchanger 32 becomes an evaporator during the cooling operation and a condenser during the heating operation similarly to the above-described outdoor heat exchanger 3 and exchanges heat between air in a space to be air-conditioned and the refrigerant. Here, in the vicinity of each indoor heat exchanger 32, a blower for efficient heat exchange between the refrigerant and air may be disposed.

The indoor throttle device 31 functions as a decompression valve or an expansion valve and adjusts the pressure of the refrigerant passing through the indoor heat exchanger 32. Here, the indoor throttle device 31 of this embodiment is assumed to be an electronic expansion valve or the like that can change the opening degree, for example. The opening degree of the indoor throttle device 31 is determined by each indoor control means 33 or the like on the basis of an overheating degree at the refrigerant outlet side of the indoor heat exchanger 32 (the gas pipe 204 side, here). Also, during the heating operation, the opening degree is determined on the basis of an overcooling degree at the refrigerant outlet side (the liquid pipe 203 side, here). The indoor control means 33 controls each means of the indoor unit 2. In this embodiment, particularly, on the basis of a temperature relating to detection by the indoor temperature sensors 121 (121*a*, 121*b*) mounted on each indoor unit 53, it is determined if the evaporation temperature of the indoor heat exchanger 32 relating to the cooling is at a predetermined temperature or less. If it is determined that the state in which the temperature is the predetermined temperature or less has continued for a predetermined time or more, the cooling by the indoor unit 53 is stopped, and control to prevent freezing of the refrigerant is executed.

The control means 300 executes determination processing and the like on the basis of a signal transmitted from various sensors disposed inside and outside the air conditioner and each device (means) of the air conditioner, for example. And the control means has a function to operate each device on the basis of the determination and integrally controls the entire operation of the air conditioner. Specifically, the control includes driving frequency control of the compressor 1, opening degree control of a flow rate controller of the throttle device, opening/closing control of the opening/closing valve, switching control of the four-way valve 2 and the like. Also, the storage means 310 stores various data, programs and the like required for the control means 300 to execute processing temporarily or for a long time. In this embodiment, the control means 300 and the storage means 310 are disposed independently in the vicinity of the outdoor unit 51, but they may be disposed in the outdoor unit 51, for example. Also, the control means 300 and the storage means 310 may be disposed at a remote location so that remote control can be made through signal communication via a public electric communication network or the like.

The air conditioner in this embodiment configured as above can perform an operation in any one of four modes, that is, the cooling only operation, the heating only operation, the cooling-main operation, and the heating-main operation as described above. Subsequently, an operation of each basic device and the flow of the refrigerant in the operation in each mode will be described.

Figure 2:
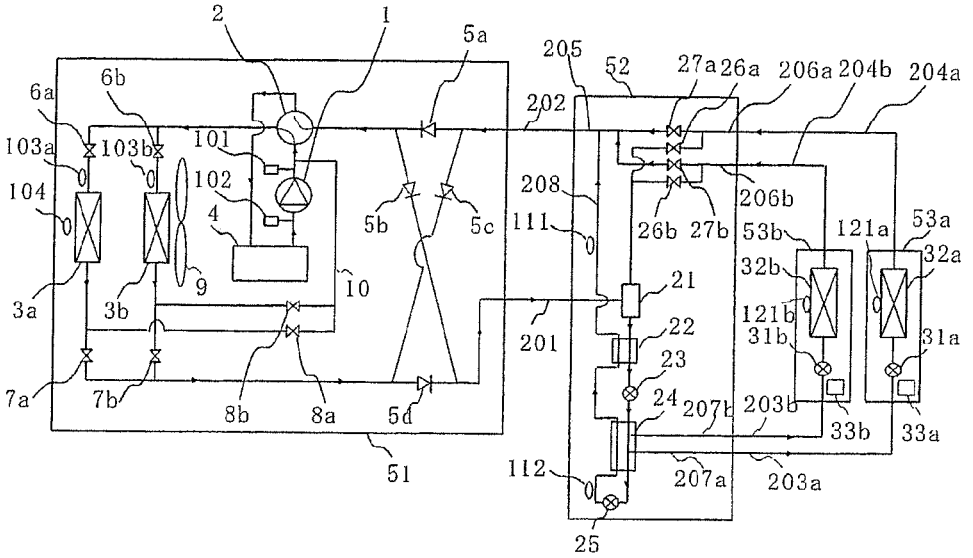
FIG. 2 is a diagram illustrating a flow of a refrigerant of a cooling only operation according to Embodiment 1.

FIG. 2 is a diagram illustrating the flow of the refrigerant in the cooling only operation according to Embodiment 1. First, on the basis of FIG. 2, the operation of each device and the flow of the refrigerant in the cooling only operation will be described. The flow of the refrigerant in the cooling only operation is indicated by solid line arrows in FIG. 2. Here, a case in which all the indoor units 53 are performing cooling without stop will be described. Also, the control means 300 opens the first channel opening/closing valves 6*a* and 6*b* and the second channel opening/closing valves 7*a* and 7*b* and closes the indoor third opening/closing valves 8*a* and 8*b*. As a result, both the indoor heat exchangers 3*a* and 3*b* are made to exchange heat (the same is assumed to be applied throughout the description on the flow of each mode).

In the outdoor unit 51, the compressor 1 compresses the sucked refrigerant and discharges the high-pressure gas refrigerant. The refrigerant discharged from the compressor 1 flows into the outdoor heat exchanger 3 through the four-way valve 2. The high-pressure gas refrigerant is condensed by heat exchange with the outside air while passing through the outdoor heat exchanger 3 and becomes a high-pressure liquid refrigerant and flows through the fourth check valve block 5*d* (does not flow through the second check valve block 5*b* and the third check valve block 5*c* sides due to the relationship of the pressure of the refrigerant). And the high-pressure liquid refrigerant flows into the divided-flow controller 52 through the high-pressure pipe 201.

The refrigerant having flowed into the divided-flow controller 52 is separated by the gas-liquid separator 21 into a gas refrigerant and a liquid refrigerant. Here, the refrigerant flowing into the divided-flow controller 52 during the cooling only operation is a liquid refrigerant, and the control means 300 makes the divided-flow-side opening/closing valves 27*a* and 27*b* open and makes the divided-flow-side opening/closing valves 26*a* and 26*b* close. Thus, no gas refrigerant flows to the indoor units 53 (53*a*, 53*b*) side from the gas-liquid separator 21. On the other hand, the liquid refrigerant passes through the first inter-refrigerant heat exchanger 22, the divided-flow-side first throttle device 23, and the second inter-refrigerant heat exchanger 24 and a part of it passes through the liquid pipes 207*a* and 207*b*. Then, it further flows into the indoor units 53*a* and 53*b* through the liquid pipes 203*a* and 203*b*.

In the indoor units 53*a*, and 53*b*, the liquid refrigerants having flowed from the liquid pipes 203*a* and 203*b*, respectively, are subjected to opening-degree adjustment and pressure adjustment by the indoor throttle devices 31*a* and 31*b*. Here, as described above, the opening-degree adjustment of each indoor throttle device 31 is made on the basis of the overheating degree at the refrigerant outlet side of each indoor heat exchanger 32. The refrigerant which has become the low-pressure liquid refrigerant or gas-liquid two-phase refrigerant by means of the opening-degree adjustment of the indoor throttle devices 31*a* and 31*b* flows into the indoor heat exchangers 32*a* and 32*b*, respectively. The low-pressure liquid refrigerant or gas-liquid two-phase refrigerant is evaporated by heat exchange with the indoor air in the space to be air-conditioned while passing through the indoor heat exchangers 32*a* and 32*b*, respectively. And it becomes a low-pressure gas refrigerant and flows into the gas pipes 204*a* and 204*b*, respectively. At this time, the indoor air is cooled by heat exchange so as to cool the room inside. Here, the gas refrigerant is used, but if a load in each indoor unit 53 is small or if in a transition state such as immediately after start or the like, the refrigerant is not fully evaporated in the indoor heat exchangers 32*a* and 32*b* but the gas-liquid two-phase refrigerant might flow. The low-pressure gas refrigerant or the gas-liquid two-phase refrigerant (low-pressure refrigerant) flowing from the gas pipes 204*a* and 204*b* passes through the gas pipes 206*a* and 206*b* and the divided-flow-side opening/closing valves 27*a* and 27*b* and flows into the low-pressure pipes 205 and 202.

On the other hand, the refrigerant not having passed through the liquid pipes 207*a* and 207*b* passes through the divided-flow-side second throttle device 25. In the second inter-refrigerant heat exchanger 24 and the first inter-refrigerant heat exchanger 22, the refrigerant flowing out of the gas-liquid separator 21 is overcooled, and the refrigerant passes through the divided-flow-side bypass pipeline 208 and flows to the low-pressure pipes 205 and 202. By overcooling the refrigerant and allowing it to flow to the indoor unit 53 side, enthalpy on the refrigerant inlet side (the liquid pipe 203 side, here) is made small, and in the indoor heat exchangers 32*a* and 32*b*, a heat exchange amount with air can be increased. Here, if the opening degree of the divided-flow-side second throttle device 25 is large and the amount of the refrigerant flowing through the divided-flow-side bypass pipeline 208 (refrigerant used for the overcooling) is increased, the amount of unevaporated refrigerant is increased. Thus, the gas-liquid two-phase refrigerant flows into the outdoor unit 51 side through the low-pressure pipes 205 and 202.

The refrigerant having flowed into the outdoor unit 51 through the low-pressure pipe 202 passes through the first check valve block 5*a*, the four-way valve 2, and the accumulator 4 and returns to the compressor 1 again so as to make circulation. This is the circulation path of the refrigerant during the cooling only operation.

Figure 3:
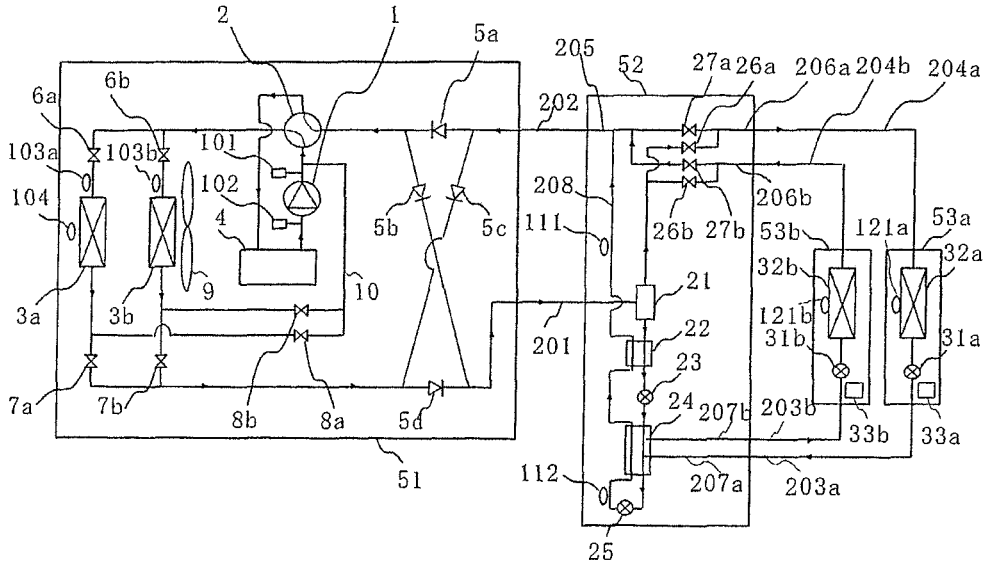
FIG. 3 is a diagram illustrating the flow of the refrigerant of a cooling-main operation according to Embodiment 1.

FIG. 3 is a diagram illustrating the flow of the refrigerant during the cooling-main operation. Here, a case in which the indoor unit 53*a* performs heating and the indoor unit 53*b* performs cooling will be described. The flow of the refrigerant in the cooling-main operation is indicated by solid line arrows in FIG. 3. First, an operation performed by each device of the outdoor unit 51 and the flow of the refrigerant are the same as in the cooling only operation described using FIG. 2. However, here, by controlling condensation of the refrigerant in the outdoor heat exchanger 3, it is assumed that the refrigerant flowing into the divided-flow controller 52 through the high-pressure pipe 201 becomes a gas-liquid two-phase refrigerant.

On the other hand, in the divided-flow controller 52, on the basis of the instruction of the control means 300, the divided-flow-side opening/closing valves 26*a* and 27*b* are closed, and the divided-flow-side opening/closing valves 27*a* and 26*b* are left open. Then, the refrigerant having flowed into the divided-flow controller 52 is separated by the gas-liquid separator 21 into the gas refrigerant and the liquid refrigerant. The flow of the refrigerant in which the separated liquid refrigerant flows through the liquid pipes 203*b* and 207*b*, reaches the indoor unit 53*b* performing cooling, passes through the low-pressure pipe 202 and flows into the outdoor unit 51 is basically the same as the flow during the cooling only operation described using FIG. 2.

On the other hand, the separated gas refrigerant passes through the divided-flow-side opening/closing valve 26*a*, the gas pipes 206*a* and 204*a* and flows into the indoor unit 53*a*. In the indoor unit 53*a*, by the opening-degree adjustment of the indoor throttle device 31*a*, the pressure of the refrigerant flowing through the indoor heat exchanger 32*a* is adjusted. Then, the high-pressure gas refrigerant is condensed by heat exchange while passing through the indoor heat exchanger 32*a* and becomes a liquid refrigerant and passes through the indoor throttle device 31*a*. At this time, the indoor air is heated by heat exchange, and the space to be air-conditioned (room inside) is heated. The refrigerant having passed through the indoor throttle device 31*a* becomes a liquid refrigerant with an intermediate pressure, in which the pressure is somewhat decreased, passes through the liquid pipes 203*a* and 207*a* and flows into the second inter-refrigerant heat exchanger 24. Then, it merges with the liquid refrigerant having flowed from the gas-liquid separator 21 and a part of it is used as the refrigerant for cooling in the indoor unit 53*b*, while the remaining part passes through the divided-flow-side second throttle device 25 and the like and flows into the low-pressure pipes 205 and 202 from the divided-flow-side bypass pipeline 208 similarly to the cooling only operation.

In the cooling-main operation as above, the outdoor heat exchanger 3 of the outdoor unit 51 functions as a condenser. Also, the refrigerant having passed through the indoor unit 53 (the indoor unit 53*a*, here) performing heating is also used as the refrigerant of the indoor unit 53 (the indoor unit 53*b*, here) performing the cooling operation. Here, if the load in the indoor unit 53*b* is small and the refrigerant flowing through the indoor unit 53*b* is suppressed or the like, the control means 300 increases the opening degree of the divided-flow-side second throttle device 25. As a result, without supplying the refrigerant more than necessary to the indoor unit 53*b* performing the cooling operation, the refrigerant can be made to flow into the low-pressure pipe 202 through the divided-flow-side bypass pipeline 208.

Figure 4:
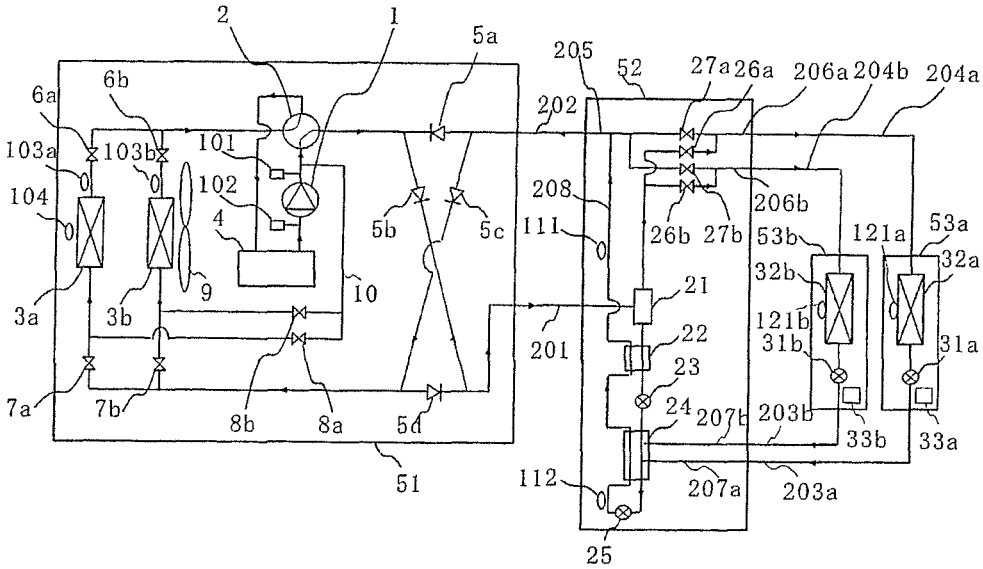
FIG. 4 is a diagram illustrating the flow of the refrigerant of a heating only operation according to Embodiment 1.

FIG. 4 is a diagram illustrating the flow of the refrigerant of the heating only operation according to Embodiment 1. Subsequently, the operation of each device and the flow of the refrigerant in the heating only operation will be described. Here, a case in which all the indoor units 53 are performing heating without stop will be described. The flow of the refrigerant in the heating only is indicated by solid line arrows in FIG. 4. In the outdoor unit 51, the compressor 1 compresses the sucked refrigerant and discharges the high-pressure gas refrigerant. The refrigerant discharged from the compressor 1 flows through the four-way valve 2 and the second check valve block 5*b* (does not flow through the first check valve block 5*a* and the fourth check valve block 5*d* sides due to the relationship of the pressure of the refrigerant) and further passes through the high-pressure pipe 201 and flows into the divided-flow controller 52.

On the other hand, in the divided-flow controller 52, on the basis of the instruction of the control means 300, the divided-flow-side opening/closing valves 26*a* and 26*b* are made to open, and the divided-flow-side opening/closing valves 27*a* and 27*b* are made to be left closed. The gas refrigerant having flowed into the divided-flow controller 52 passes through the gas-liquid separator 21, the divided-flow-side opening/closing valves 26*a* and 26*b*, and the gas pipes 206*a*, 206*b*, 204*a*, and 204*b* and flows into the indoor units 53*a* and 53*b*.

In the indoor units 53*a* and 53*b*, by means of the opening-degree adjustment of the indoor throttle devices 31*a* and 31*b*, the pressure of the refrigerant flowing through the indoor heat exchangers 32*a* and 32*b* is adjusted. Then, the high-pressure gas refrigerant is condensed by heat exchange while passing through the indoor heat exchangers 32*a* and 32*b* and becomes a liquid refrigerant and passes through the indoor throttle devices 31*a* and 31*b*. At this time, the indoor air is heated by heat exchange, and the space to be air-conditioned (room inside) is heated.

The refrigerant having passed through the indoor throttle devices 31*a* and 31*b* becomes a liquid refrigerant with an intermediate pressure or a gas-liquid two-phase refrigerant, for example, passes through the liquid pipes 203*a*, 203*b*, 207*a*, and 207*b*, flows into the second inter-refrigerant heat exchanger 24 and further passes through the divided-flow-side second throttle device 25. The refrigerant having passed through the divided-flow-side second throttle device 25 and having been decompressed flows from the divided-side bypass pipeline 208 to the low-pressure pipes 205 and 202 and flows into the outdoor unit 51.

The refrigerant having flowed into the outdoor unit 51 passes through the third check valve block 5*c* of the outdoor unit 51 and flows into the outdoor heat exchanger 3. The refrigerant is evaporated by heat exchange with air while passing through the outdoor heat exchanger 3 and becomes a gas refrigerant. Then, the refrigerant passes through the four-way valve 2 and the accumulator 4, returns to the compressor 1 again and is discharged. This is a circulation path of the refrigerant during the heating only operation.

Here, in the above-described cooling only operation and heating only operation, description was made supposing that all the indoor units 53*a* and 53*b* are operated, but a part of the indoor units may be stopped, for example. Also, if a part of the indoor units 53 is stopped and a load as the entire air conditioner is small, the capacity may be changed by change of a discharge capacity relating to a change of the driving frequency of the compressor 1 or stopping either one of them or the like. The heat exchange amount may also be changed by controlling refrigerant inflow in the outdoor heat exchangers 3 (3*a*, 3*b*), for example, by means of the first channel opening/closing valves 6 (6*a*, 6*b*) and the second channel opening/closing valves 7 (7*a* and 7*b*).

Figure 5:
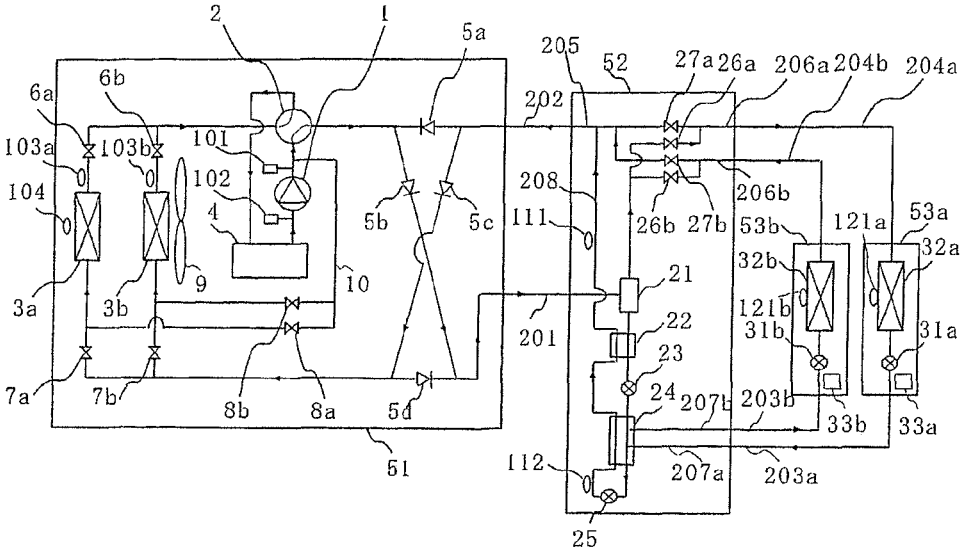
FIG. 5 is a diagram illustrating the flow of the refrigerant of a heating-main operation according to Embodiment 1.

FIG. 5 is a diagram illustrating the flow of the refrigerant of the heating-main operation according to Embodiment 1. Here, a case in which the indoor unit 53*a* performs the heating operation and the indoor unit 53*b* performs the cooling operation will be described. The flow of the refrigerant during the heating-main operation is indicated by solid line arrows in FIG. 5. The operation of each device and the flow of the refrigerant in the outdoor unit 51 are the same as the heating only described using FIG. 4.

On the other hand, in the divided-flow controller 52, on the basis of the instruction of the control means 300, the divided-flow-side opening/closing valves 26*a* and 27*b* are made to open, and the divided-flow-side opening/closing valves 27*a* and 26*b* are made to be left closed. The gas refrigerant having flowed into the divided-flow controller 52 passes through the gas-liquid separator 21, the divided-flow-side opening/closing valve 26*a*, and the gas pipes 206*a* and 204*a* and flows into the indoor unit 53*a*.

In the indoor unit 53*a*, similarly to FIG. 4, by means of the opening-degree adjustment of the indoor throttle device 31*a*, the pressure of the refrigerant flowing through the indoor heat exchanger 32*a* is adjusted. Then, the high-pressure gas refrigerant is condensed by heat exchange while passing through the indoor heat exchangers 32*a* and 32*b* and becomes a liquid refrigerant and passes through the indoor throttle devices 31*a* and 31*b*. At this time, the indoor air is heated by heat exchange, and the space to be air-conditioned (room inside) is heated.

The refrigerant having passed through the indoor throttle device 31*a* becomes a liquid refrigerant with an intermediate pressure, for example, passes through the liquid pipes 203*a* and 207*a* and flows into the second inter-refrigerant heat exchanger 24. Then, a part of the refrigerant having flowed into the second inter-refrigerant heat exchanger 24 passes through the liquid pipes 207*b* and 203*b* and flows into the indoor unit 53*b*.

In the indoor unit 53*b*, the indoor throttle device 31*b* adjusts the pressure by means of the opening-degree adjustment. The refrigerant which has become a low-pressure liquid refrigerant or a gas-liquid two-phase refrigerant by means of the opening-degree adjustment of the indoor throttle device 31*b* passes through the indoor heat exchanger 32*b*. While passing through the indoor heat exchanger 32*b*, the refrigerant is evaporated by heat exchange with the indoor air in the space to be air-conditioned. Then, the refrigerant becomes a low-pressure refrigerant and flows into the gas pipe 204*b*. At this time, the indoor air is cooled by heat exchange so as to cool the room inside. The refrigerant having flowed out of the gas pipe 204*b* further passes through the gas pipe 206*b* and the divided-flow-side opening/closing valve 27*b* and flows into the low-pressure pipes 205 and 202.

On the other hand, the remaining of the refrigerant having flowed into the second inter-refrigerant heat exchanger 24 passes through the divided-flow-side second throttle device 25. The refrigerant having passed through the divided-flow-side second throttle device 25 and having been decompressed overcools the refrigerant with an intermediate pressure having passed through the liquid pipes 203*a* and 207*a*, while a part of it is evaporated, flows into the low-pressure pipes 205 and 202 through the divided-flow-side bypass pipeline 208 and flows into the outdoor unit 51.

In the heating-main operation, the refrigerant having flowed out of the indoor unit (the indoor unit 20*a*, here) performing the heating flows into the indoor unit (the indoor unit 20*b*, here) performing the cooling. Thus, if the indoor unit 53 performing the cooling operation is stopped, the amount of the gas-liquid two-phase refrigerant flowing through the divided-flow-side bypass pipeline 208 is increased. On the contrary, if a load in the indoor unit 53 performing the cooling is increased, the amount of the refrigerant flowing through the divided-flow-side bypass pipeline 208 is decreased. Thus, while the amount of the refrigerant required by the indoor unit 53 performing the heating is unchanged, the load of the indoor heat exchanger 32 (evaporator) in the indoor unit 53 performing the cooling is changed.

Figure 6:
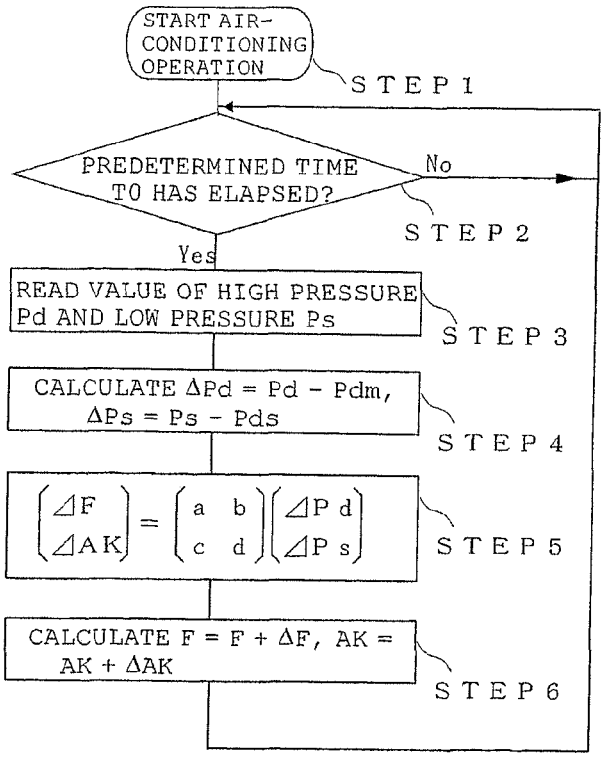
FIG. 6 is a diagram illustrating a flowchart of a compressor 1 and a heat exchange amount of an outdoor heat exchanger 3 during an operation.

FIG. 6 is a diagram illustrating a flowchart according to determination made by the control means 300 of the driving frequency of the compressor 1 of the outdoor unit 51 and the heat exchange amount of the outdoor heat exchanger 3. The control means 300 controls the driving frequency of the compressor 1 and the heat exchange amount of the outdoor heat exchanger 3 so that the pressures of the refrigerant on the discharge side and the suction side of the compressor 1 become predetermined target values.

When an air-conditioning operation is started (STEP 1), the control means 300 determines if a predetermined time T0 has elapsed or not (STEP 2). A value of the high pressure Pd on the basis of a signal from the first pressure sensor 101 mounted on the discharge side of the compressor 1 and a value of the low pressure Ps on the basis of a signal from the second pressure sensor 102 mounted on the suction side are read (STEP 3).

Then, a difference ΔPdm between the high pressure Pd and a high-pressure target value Pdm is calculated. Also, a difference ΔPsm between the low pressure Ps and a low-pressure target value Psm is calculated (STEP 4). Moreover, the calculated ΔPdm and ΔPsm are substituted into the following equations (1) and (2) so as to calculate a correction value ΔF of the frequency of the compressor 1 and a correction value ΔAK of the heat exchange amount of the outdoor heat exchanger 3 (STEP 5), where a, b, c, and d designate coefficients:

$$\Delta F = a\Delta Pd + b\Delta Ps \quad (1)$$

$$\Delta AK = c\Delta Pd + d\Delta Ps \quad (2)$$

By means of the correction values ΔF and ΔAK, a new value F of the driving frequency and a new heat exchange amount AK obtained by correcting the value F of the driving frequency and the heat exchange amount AK are determined (STEP 6). Then, on the basis of the determined driving frequency F, the discharge amount of the refrigerant of the compressor 1 is controlled. Also, on the basis of the heat exchange amount AK, the rotation speed of the blower 9 is controlled, and the heat exchange amount is controlled. Here, if the load on the indoor unit 53 side is small and the heat exchange amount may be small or the like, it may be so configured that the first channel opening/closing valve 6 and the second channel opening/closing valve 7 are closed, and the heat transfer area of the entire outdoor heat exchanger 3 is increased/decreased so as to control the heat exchange amount.

Figure 7:
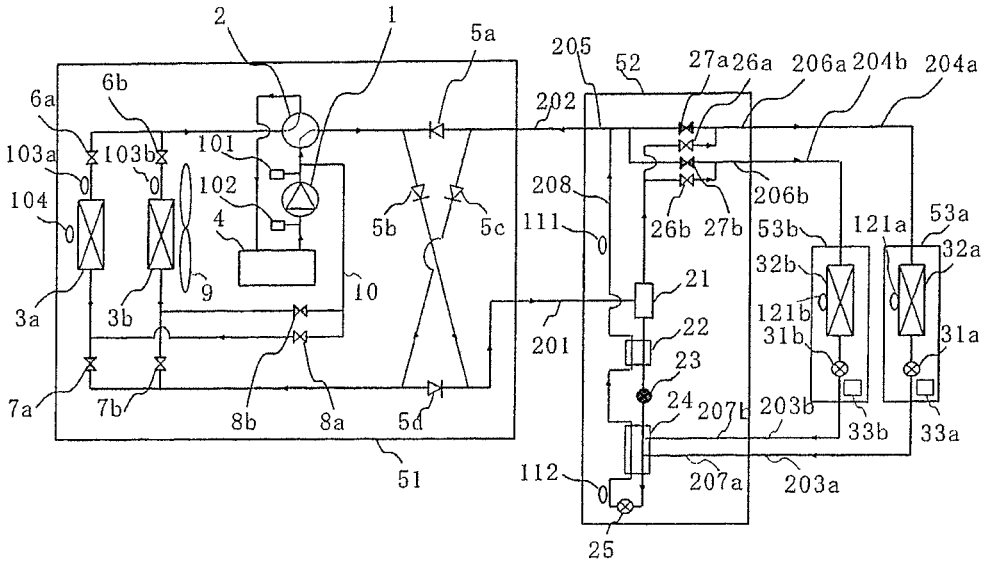
FIG. 7 is a diagram illustrating the flow of the refrigerant during defrosting of the heating only operation according to Embodiment 1.
Figure 8:
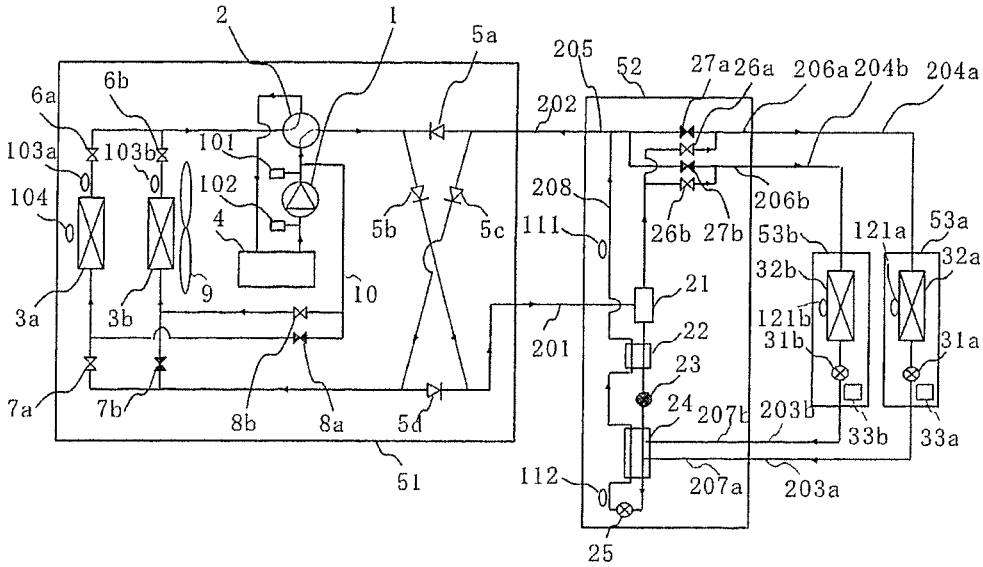
FIG. 8 is a diagram illustrating another flow of the refrigerant during defrosting of the heating only operation according to Embodiment 1.

FIGS. 7 and 8 are diagrams illustrating the flow of the refrigerant when the defrosting operation is performed during the heating only operation in the air conditioner according to Embodiment 1. FIG. 7 illustrates the flow of the refrigerant when the defrosting of the outdoor heat exchanger 3*a* is performed during the heating only operation. FIG. 8 illustrates the flow of the refrigerant when the defrosting of the outdoor heat exchanger 3*b* is performed during the heating only operation. The flow of the refrigerant in the refrigerant circuit of the heating only operation is basically the same as the one described using FIG. 4. Also, description will be made only for the heating only operation here, but the outdoor unit 51 performs the same to the case in which the defrosting operation is performed during the heating-main operation. Here, if the defrosting operation is to be performed, the defrosting operation is not performed for the outdoor heat exchangers 3*a* and 3*b* at the same time.

As shown in FIG. 7, after the heating only operation is continued for a predetermined period of time, if the control means 300 determines that the defrosting operation is to be performed, it opens the bypass opening/closing valve 8*a*, closes the second channel opening/closing valve 7*a* and stops the blower 9. Also, if the refrigerant is allowed to flow into the outdoor heat exchanger 3*b*, for example, the second channel opening/closing valve 7*b* is opened. By continuing the heating only operation or the heating-main operation in this state, the gas-liquid two-phase refrigerant having flowed-in through the low-pressure pipe 202 flows only into the outdoor heat exchanger 3*b* through the third check valve block 5*c* and the second channel opening/closing valve 7*b* and is evaporated/vaporized.

On the other hand, since the bypass opening/closing valve 8*a* is opened, a part of the high-temperature and high-pressure gas refrigerant discharged from the compressor 1 flows into the outdoor heat exchanger 3*a* through the bypass opening/closing valve 8*a*. Through heat exchange between the high-temperature gas refrigerant and frost, the frost formed on the outdoor heat exchanger 3*a* is melted, and the refrigerant turns into a low-temperature gas refrigerant. The gas refrigerant passes through the first channel opening/closing valve 6*a*, merges with the gas refrigerant having flowed out of the outdoor heat exchanger 3*b* and returns to the compressor 1 through the four-way valve 2 and the accumulator 4. By stopping the blower 9 during the defrosting, the heat of the refrigerant can be heat-exchanged with the frost easily, and defrosting in a short time is possible.

Also, as shown in FIG. 8, if it is determined that the defrosting of the outdoor heat exchanger 3*a* has been finished, the bypass opening/closing valve 8*a* is closed, and the second channel opening/closing valve 7*a* is opened. Then, after a predetermined time has elapsed, for example, the bypass opening/closing valve 8*b* is opened, and the second channel opening/closing valve 7*b* is closed. In this state, the refrigerant flows only into the outdoor heat exchanger 3*a* through the second channel opening/closing valve 7*a* and is evaporated/vaporized. Also, a part of the high-temperature and high-pressure gas refrigerant discharged from the compressor 1 flows into the outdoor heat exchanger 3*b* through the bypass opening/closing valve 8*b* and melts the frost. The gas refrigerant whose temperature has been lowered by heat exchange with the frost passes through the first channel opening/closing valve 6*b*, merges with the gas refrigerant having flowed out of the outdoor heat exchanger 3*a* and returns to the compressor 1 through the four-way valve 2 and the accumulator 4.

Figure 9:
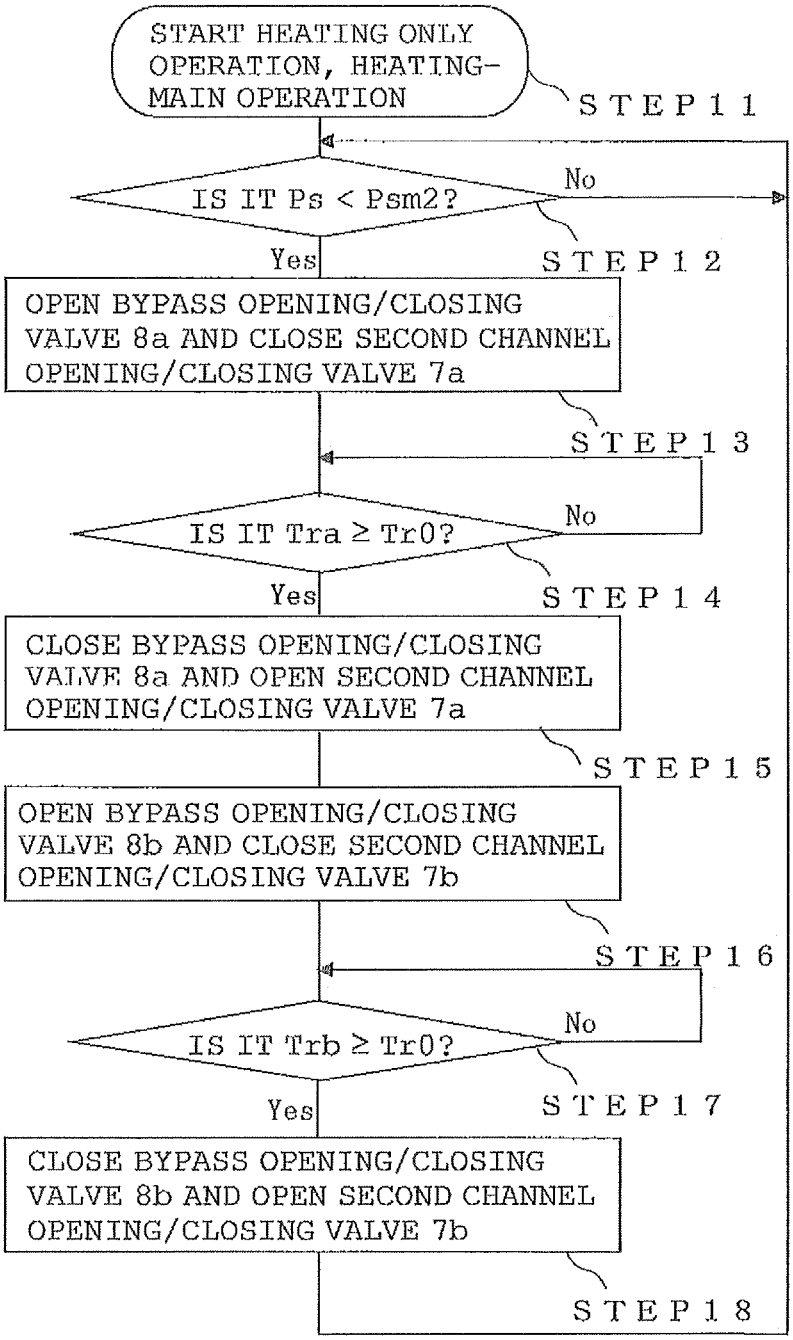
FIG. 9 is a diagram illustrating a flowchart according to a defrosting operation in Embodiment 1.

FIG. 9 is a diagram illustrating a flowchart according to the defrosting operation performed by the control means 300 in Embodiment 1. When the heating only operation or heating-main operation by the air conditioner is started (STEP 11), it is determined whether the value of the low pressure Ps on the basis of the signal from the second pressure sensor 102 mounted on the suction side of the compressor 1 is lower than a low-pressure target value Psm2 or not (STEP 12). If it is determined that the value of the low pressure Ps is lower than the target value Psm2, the bypass opening/closing valve 8*a* is opened, the second channel opening/closing valve 7*a* is closed, and defrosting of the outdoor heat exchanger 3*a* is started as described above (STEP 13). Then, it is determined if a temperature Tra on the basis of the signal from the temperature sensor 103*a* is at a predetermined value Tr0 or more (STEP 14). And until it is determined that the temperature Tra is at the predetermined value Tr0 or more, defrosting of the outdoor heat exchanger 3*a* is continued.

If it is determined that the temperature Tra is at the predetermined value Tr0 or more, the bypass opening/closing valve 8*a* is closed, and the second channel opening/closing valve 7*a* is opened (STEP 15). Also, after a predetermined time has elapsed, the bypass opening/closing valve 8*b* is opened, and the second channel opening/closing valve 7*b* is closed (STEP 16). Then, it is determined if a temperature Trb on the basis of the signal from the temperature sensor 103*b* is at the predetermined value Tr0 or more (STEP 17). Defrosting of the outdoor heat exchanger 3*b* is continued until it is determined that the temperature Trb is at the predetermined value Tr0 or more.

If it is determined that the temperature Trb is at the predetermined value Tr0 or more, the bypass opening/closing valve 8*b* is closed, and the second channel opening/closing valve 7*b* is opened (STEP 18). Then, the routine returns to STEP 12 and continues processing.

Here, if the defrosting operation is performed while the heating only operation or the heating-main operation is continued, too, as described using FIG. 6, the driving frequency of the compressor 1 and the heat exchange amount of the outdoor heat exchanger 3 are controlled so that the pressures of the refrigerant on the discharge side and the suction side of the compressor 1 become predetermined target values.

Basically, the processing relating to the determination of the driving frequency of the compressor 1 in the outdoor unit 51 and the heat exchange amount of the outdoor heat exchanger 3 and the processing relating to the defrosting operation described using FIG. 9 are performed independently. However, immediately after the driving frequency of the compressor 1 and the heat exchange amount of the outdoor heat exchanger 3 are changed, the low pressure Ps is largely changed. Thus, in the processing relating to the defrosting operation, after the predetermined time T0 at STEP 2 in FIG. 9 has elapsed, on the basis of the value of the low pressure Ps read on the basis of the signal from the second pressure sensor 102, the determination at STEP 12 in FIG. 9 is made. As a result, by making determination in a stable pressure state, determination relating to the defrosting operation is not mistaken.

Also, in the outdoor unit 51, during the defrosting operation, since hot gas from the compressor 1 is divided to the bypass pipeline 10 for defrosting, the pressure on the discharge side (high-pressure side) is largely lowered due to opening of the bypass opening/closing valve 8. Also, at the end of the defrosting of each outdoor heat exchanger 3, it is largely raised due to closing of the bypass opening/closing valve 8. Such pressure fluctuation at the start of the defrosting operation and the end of the defrosting operation of each outdoor heat exchanger 3 is preferably handled. For example, when the control means 300 executes the processing relating to the determination of the driving frequency of the compressor 1 and the heat exchange amount of the outdoor heat exchanger 3 during the defrosting operation, the control means changes the coefficients a, b, c, and d in the above-described equations (1) and (2). As a result, the high pressure in the refrigerant circuit can be stably maintained, and even during the defrosting operation, the compressor 1 can exert (supply) the stable heating capacity. Alternatively, the coefficients may be able to be changed in each operation mode. These coefficients are stored in the storage means 310 as data, for example.

Also, since the number of the outdoor heat exchangers 3 functioning as evaporators is decreased during the defrosting operation, the pressure on the suction side (low-pressure side) is lowered. Due to this lowering, in the heating-main operation, for example, an evaporation temperature of the indoor heat exchanger 31 in the indoor unit 53 relating to the cooling might become a predetermined temperature (0° C., for example) or less. Thus, moisture in air in the space to be air-conditioned might be frozen (frost formation) in the indoor heat exchanger 31. By this freezing, an airflow amount of air to be fed into the space to be air-conditioned is decreased. Alternatively, in the case of thawing (defrosting) by providing a defrosting function, melted water might flow out of a drain pan and cause water leakage, for example.

Thus, the indoor control means 33 of the indoor unit 53 performing cooling determines if the evaporation temperature of the indoor heat exchanger 32 is at a predetermined temperature or less on the basis of the temperature relating to detection of the indoor temperature sensor 121, for example. If it is determined that a state at the predetermined temperature or less has continued for a predetermined time or more, the operation of the indoor unit 53 is stopped for a time being, and the refrigerant is not allowed to flow into the indoor heat exchanger 31 so as to prevent freezing of the moisture in air. Alternatively, it may be so configured that air is fed into the indoor heat exchanger 31 by rotating only the blower (not shown) so as to melt the frost by heat of air. When a predetermined time has elapsed, cooling is performed again. Here, the indoor temperature sensor 121 is mounted, but a pressure sensor may be mounted on the side to become a low pressure so that determination is made by estimating a saturated temperature on the basis of the pressure. Also, the indoor control means 33 of each indoor unit 53 makes determination, here, but the control means 300 may make integral determination, for example.

As described above, according to the air conditioner of Embodiment 1, since the plurality of outdoor heat exchangers 3 are connected in parallel to the outdoor unit 51 by a pipeline, the control means 300 controls opening/closing of the second channel opening/closing valve 7 and the bypass opening/closing valve 8, and the hot gas is made to sequentially flow into each outdoor heat exchanger 3 through the bypass pipeline 10 for defrosting so as to perform defrosting, the defrosting operation can be performed while the heating only operation and the heating-main operation are continued even if there is only one outdoor unit 51. Thus, while the defrosting operation is performed, a comfortable room temperature environment can be maintained without stopping cooling/heating on the indoor unit 53 side. And since there is only one outdoor unit 51, a cost can be kept low. Also, an installation space can be made small.

Also, during the defrosting operation, by controlling the driving frequency of the compressor 1 and the heat exchange amount of the outdoor heat exchanger 3, even if the number of outdoor heat exchangers 3 used for the heating only operation and the heating-main operation is decreased due to the defrosting operation, the situation can be handled. Also, when the low pressure side in the refrigerant circuit is lowered during the heating-main operation, the evaporation temperature of the indoor heat exchanger 32 of the indoor unit 53 performing cooling might be lowered. In this embodiment, if the indoor control means 33 determines that the evaporation temperature is at a predetermined temperature or less, the operation is stopped, and thus, freezing can be prevented.

Embodiment 2

Figure 10:
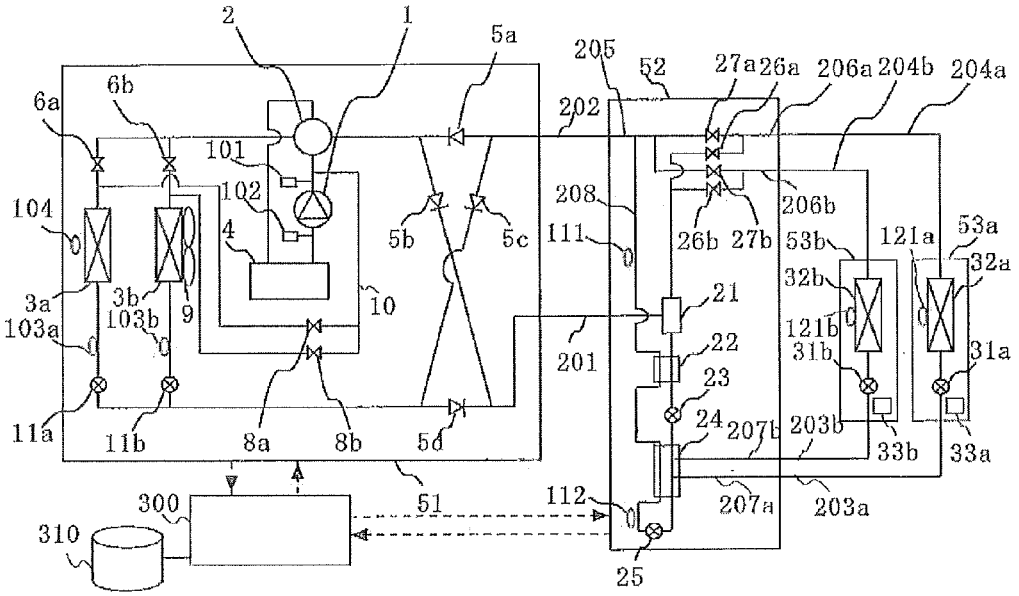
FIG. 10 is a diagram illustrating a configuration of an air conditioner and a refrigerant circuit according to Embodiment 2.

FIG. 10 is a diagram illustrating a configuration of an air conditioner according to Embodiment 2 of the present invention. In FIG. 10, means with the same reference numerals as in FIG. 1 and the like perform the similar operations as described in Embodiment 1. In FIG. 10, outdoor throttle devices 11 (11*a*, 11*b*) adjust flow rates of the refrigerants flowing into/out of the outdoor heat exchangers 3*a* and 3*b* and are installed instead of the second channel opening/closing valves 7*a* and 7*b*. Here, in this embodiment, as for the other end divided in the middle of the bypass pipeline 10 for defrosting, one of the other ends is connected to a pipeline that connects the outdoor throttle device 11*a* and the outdoor heat exchanger 3*a*. Also, the other of the other ends is connected to a pipeline that connects the outdoor throttle device 11*b* and the outdoor heat exchanger 3*b*.

The flow of the refrigerant in the cooling only operation, the cooling-main operation, the heating only operation, and the heating-main operation in the air conditioner of this embodiment is the same as in Embodiment 1.

Figure 11:
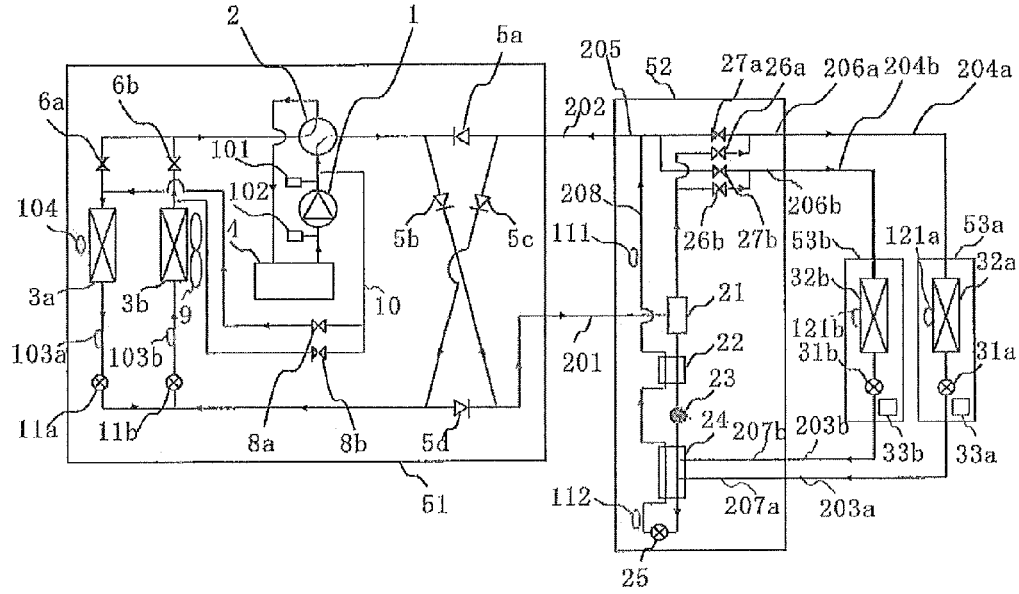
FIG. 11 is a diagram illustrating a flow of a refrigerant during defrosting of a heating only operation according to Embodiment 2.
Figure 12:
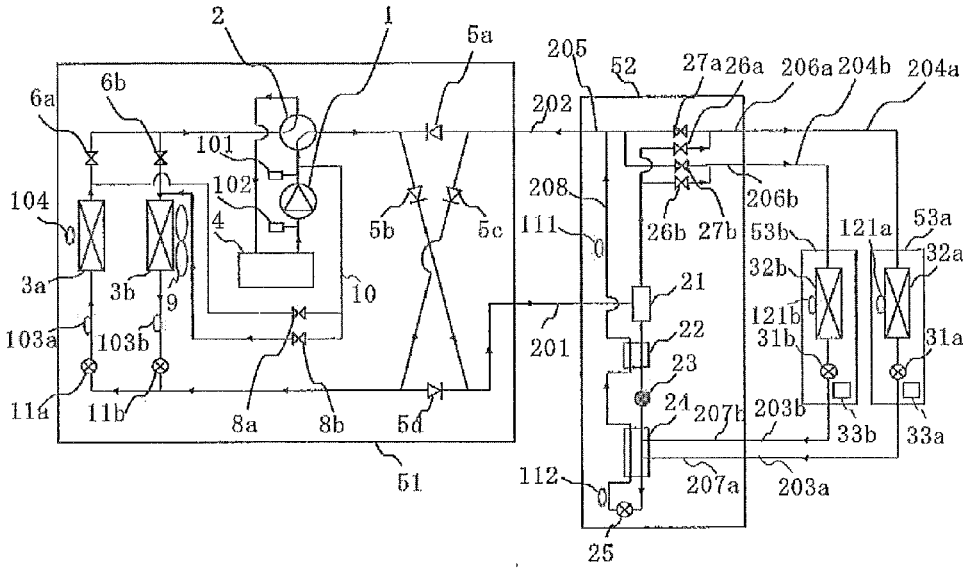
FIG. 12 is a diagram illustrating another flow of the refrigerant during defrosting of the heating only operation according to Embodiment 2.

FIGS. 11 and 12 are diagrams illustrating the flow of the refrigerant when the defrosting operation is performed during the heating only operation in the air conditioner according to Embodiment 2. FIG. 11 illustrates the flow of the refrigerant when the defrosting of the outdoor heat exchanger 3*a* is performed during the heating only operation. FIG. 12 illustrates the flow of the refrigerant when the defrosting of the outdoor heat exchanger 3*b* is performed during the heating only operation. The flow of the refrigerant in the refrigerant circuit during the heating only operation is basically the same as described using FIG. 4.

After the heating only operation is continued for a predetermined period of time, if the control means 300 determines that the defrosting operation is to be performed, it opens the bypass opening/closing valve 8*a* and sets the outdoor throttle device 11*a* at an opening degree for defrosting determined in advance. Also, as described in Embodiment 1, for example, on the basis of the heat exchange amount to be heat-exchanged in the outdoor heat exchanger 3*b*, the outdoor throttle device 11*b* is set at a predetermined opening degree (hereinafter referred to as an opening degree for heating).

As shown in FIG. 11, by opening the bypass opening/closing valve 8*a*, a part of the high-temperature and high-pressure gas refrigerant discharged from the compressor 1 passes through the bypass pipeline 10 for defrosting and flows into the outdoor heat exchanger 3*a*. By means of heat exchange between the high-temperature gas refrigerant and the frost, the frost formed on the outdoor heat exchanger 3*a* is melted, and the refrigerant is liquefied by condensation. The liquid refrigerant passes through the outdoor throttle device 11*a*. And it merges with the gas-liquid two-phase refrigerant having passed through the low-pressure pipe 202 and the third check valve block 5*c*, flows only into the outdoor heat exchanger 3*a* through the outdoor throttle device 11*b* and is evaporated/vaporized. Then, it returns to the compressor 1 through the open valve 6*b* and the accumulator 4.

Also, if the control means determines that defrosting of the outdoor heat exchanger 3*a* is finished, the control means 300 closes the bypass opening/closing valve 8*a*. Also, on the basis of the heat exchange amount to be heat-exchanged in the outdoor heat exchanger 3*a*, the outdoor throttle device 11*a* is set at the opening degree for heating. Then, the bypass opening/closing valve 8*b* is opened, and the outdoor throttle device 11*b* is set at the opening degree for defrosting determined in advance.

As shown in FIG. 12, by opening the bypass opening/closing valve 8*b*, a part of the high-temperature and high-pressure gas refrigerant discharged from the compressor 1 passes through the bypass pipeline 10 for defrosting and flows into the outdoor heat exchanger 3*b*. By means of heat exchange between the high-temperature gas refrigerant and the frost, the frost formed on the outdoor heat exchanger 3*b* is melted, and the refrigerant is liquefied by condensation. The liquid refrigerant passes through the outdoor throttle device 11*b*. And it merges with the gas-liquid two-phase refrigerant having passed through the low-pressure pipe 202 and the third check valve block 5*c*, flows only into the outdoor heat exchanger 3*a* through the outdoor throttle device 11*a* and is evaporated/vaporized. Then, it returns to the compressor 1 through the open valve 6*a* and the accumulator 4.

Figure 13:
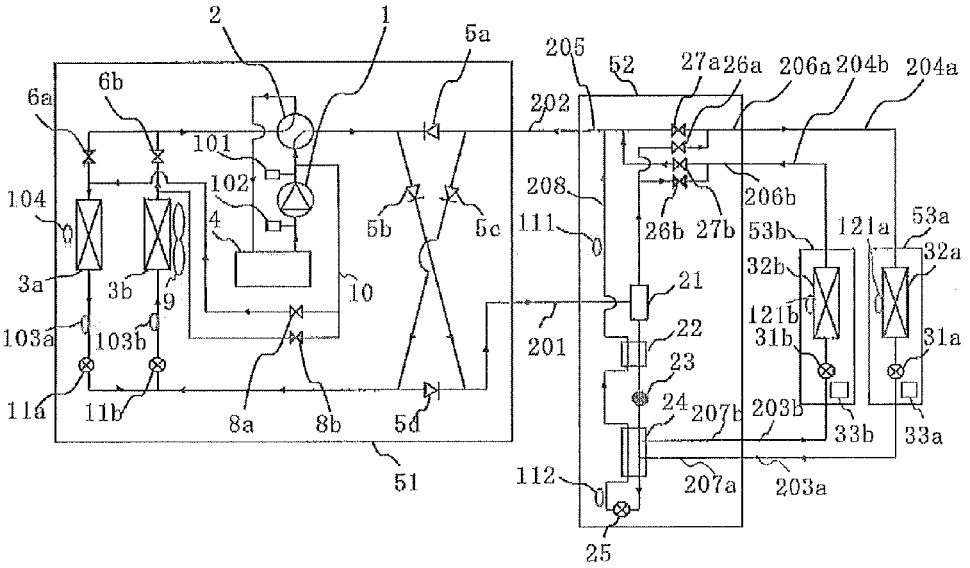
FIG. 13 is a diagram illustrating the flow of the refrigerant during defrosting of a heating-main operation according to Embodiment 2.
Figure 14:
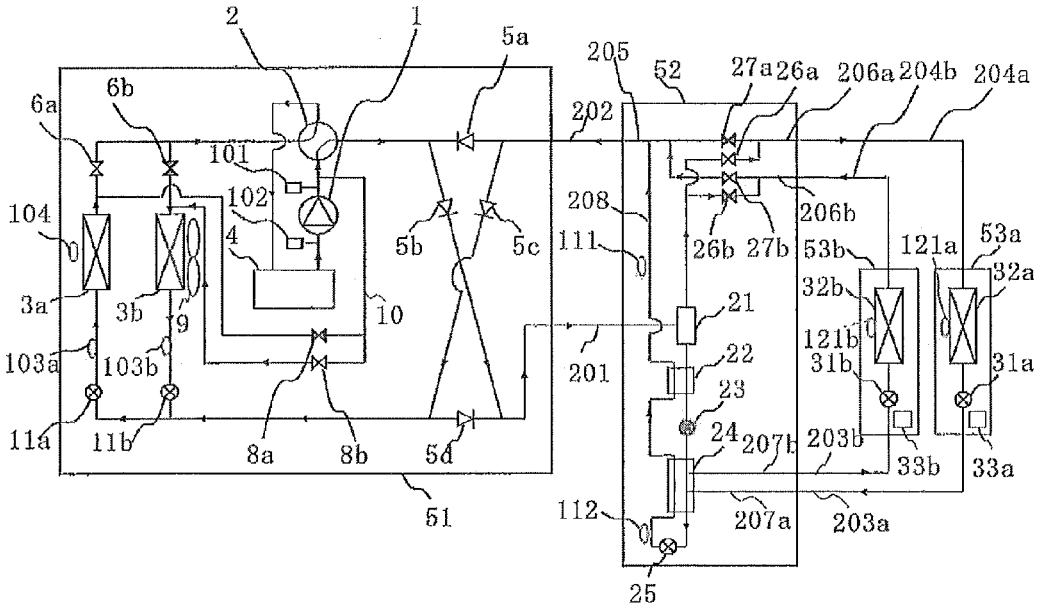
FIG. 14 is a diagram illustrating another flow of the refrigerant during defrosting of the heating-main operation according to Embodiment 2.

FIGS. 13 and 14 are diagrams illustrating the flow of the refrigerant if the defrosting operation is performed during the heating-main operation in the air conditioner according to Embodiment 2. FIG. 13 illustrates the flow of the refrigerant when the defrosting of the outdoor heat exchanger 3*a* is performed during the heating-main operation. FIG. 14 illustrates the flow of the refrigerant when the defrosting of the outdoor heat exchanger 3*b* is performed during the heating-main operation. The flow of the refrigerant in the refrigerant circuit during the heating-main operation is basically the same as the one described using FIG. 5.

After the heating-main operation is continued for a predetermined period of time, if the control means 300 determines that the defrosting operation is to be performed, it makes the bypass opening/closing valve 8*a* open and makes the outdoor throttle device 11*a* set at the opening degree for defrosting determined in advance. Also, as described in Embodiment 1, for example, on the basis of the heat exchange amount to be heat-exchanged in the outdoor heat exchanger 3*b*, the outdoor throttle device 11*b* is made to set at the opening degree for heating.

As shown in FIG. 13, by opening the bypass opening/closing valve 8*a*, a part of the high-temperature and high-pressure gas refrigerant discharged from the compressor 1 passes through the bypass pipeline 10 for defrosting and flows into the outdoor heat exchanger 3*a*. By means of heat exchange between the high-temperature gas refrigerant and the frost, the frost formed on the outdoor heat exchanger 3*a* is melted, and the refrigerant is liquefied by condensation. The liquid refrigerant passes through the outdoor throttle device 11*a*. And it merges with the gas-liquid two-phase refrigerant having passed through the low-pressure pipe 202 and the third check valve block 5*c*, flows only into the outdoor heat exchanger 3*b* through the outdoor throttle device 11*b* and is evaporated/vaporized. Then, it returns to the compressor 1 through the open valve 6*b* and the accumulator 4.

Also, if the control means 300 determines that defrosting of the outdoor heat exchanger 3*a* is finished, the control means 300 closes the bypass opening/closing valve 8*a*. Also, on the basis of the heat exchange amount to be heat-exchanged in the outdoor heat exchanger 3*a*, the outdoor throttle device 11*a* is set at the opening degree for heating. Then, the bypass opening/closing valve 8*b* is opened, and the outdoor throttle device 11*b* is set at the opening degree for defrosting determined in advance.

As shown in FIG. 14, by opening the bypass opening/closing valve 8*b*, a part of the high-temperature and high-pressure gas refrigerant discharged from the compressor 1 passes through the bypass pipeline 10 for defrosting and flows into the outdoor heat exchanger 3*b*. By means of heat exchange between the high-temperature gas refrigerant and the frost, the frost formed on the outdoor heat exchanger 3*b* is melted, and the refrigerant is liquefied by condensation. The liquid refrigerant passes through the outdoor throttle device 11*b*. And it merges with the gas-liquid two-phase refrigerant having passed through the low-pressure pipe 202 and the third check valve block Sc, flows only into the outdoor heat exchanger 3*a* through the outdoor throttle device 11*a* and is evaporated/vaporized. Then, it returns to the compressor 1 through the open valve 6*a* and the accumulator 4.

Figure 15:
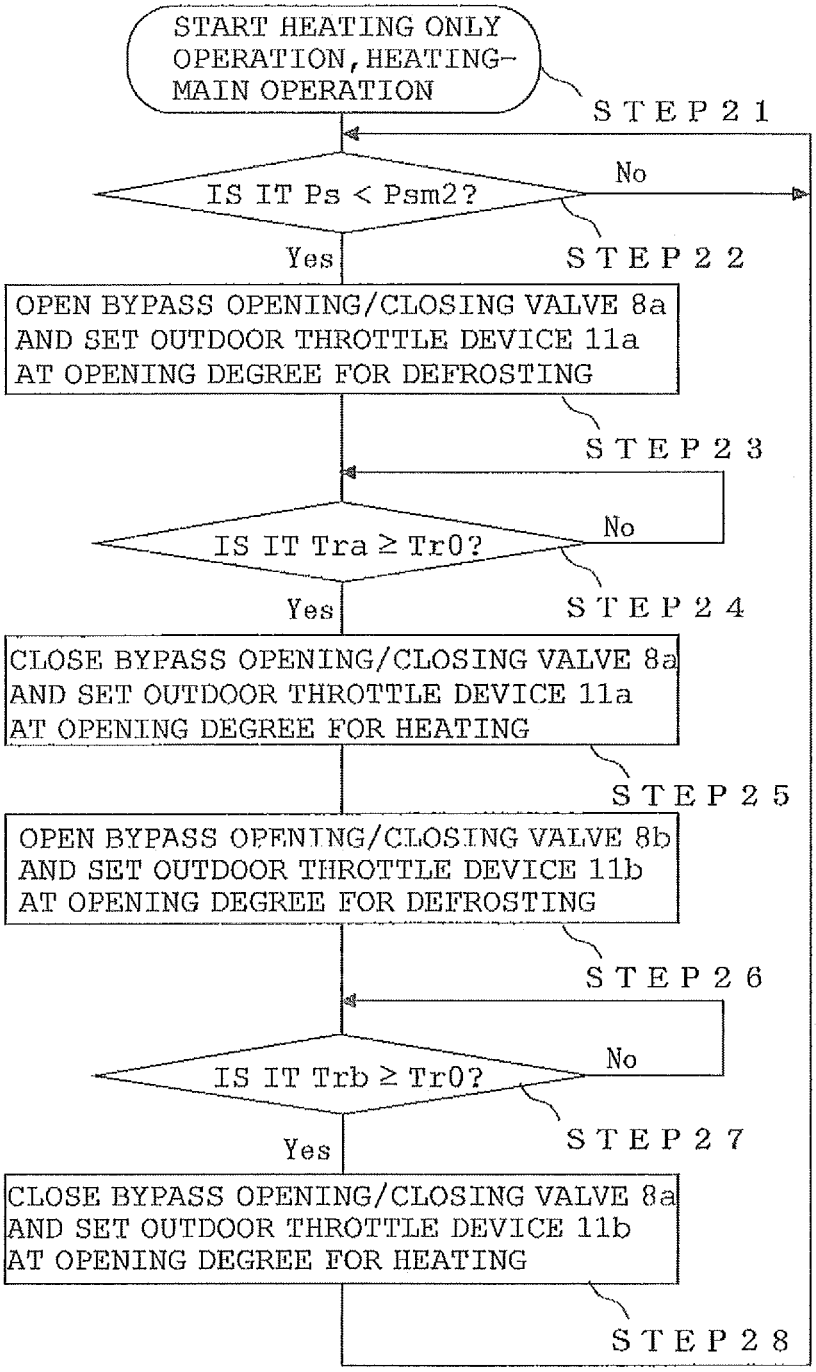
FIG. 15 is a diagram illustrating a flowchart according to a defrosting operation in Embodiment 2.

FIG. 15 is a diagram illustrating a flowchart according to the defrosting operation performed by the control means 300 in Embodiment 2. When the heating only operation or heating-main operation by the air conditioner is started (STEP 21), it is determined whether the value of the low pressure Ps on the basis of the signal from the second pressure sensor 102 mounted on the suction side of the compressor 1 is lower than a low-pressure target value Psm2 or not (STEP 22). If it is determined that the value of the low pressure Ps is lower than the target value Psm2, the bypass opening/closing valve 8*a* is opened, the outdoor throttle device 11*a* is set at the opening degree for defrosting, and defrosting of the outdoor heat exchanger 3*a* is started as described above (STEP 23). Then, it is determined if the temperature Tra on the basis of the signal from the temperature sensor 103*a* is at the predetermined value Tr0 or more (STEP 24). And until it is determined that the temperature Tra is at the predetermined value Tr0 or more, defrosting of the outdoor heat exchanger 3*a* is continued.

If it is determined that the temperature Tra is at the predetermined value Tr0 or more, the bypass opening/closing valve 8*a* is closed, and the outdoor throttle device 11*a* is set at the opening degree for heating (STEP 25). Also, after a predetermined time has elapsed, the bypass opening/closing valve 8*b* is opened, and the outdoor throttle device 11*b* is set at the opening degree for defrosting (STEP 26). Then, it is determined if a temperature Trb on the basis of the signal from the temperature sensor 103*b* is at the predetermined value Tr0 or more (STEP 27). Defrosting of the outdoor heat exchanger 3*b* is performed until it is determined that the temperature Trb is at the predetermined value Tr0 or more.

If it is determined that the temperature Trb is at the predetermined value Tr0 or more, the bypass opening/closing valve 8*b* is closed, and the outdoor throttle device 11*b* is set at the opening degree for heating (STEP 28). Then, the routine returns to STEP 22 and continues processing.

As described above, according to the air conditioner of Embodiment 2, since the plurality of outdoor heat exchangers 3 are connected in parallel to the outdoor unit 51 by a pipeline, the control means 300 controls the opening degree of the outdoor throttle device 11 and opening/closing of the bypass opening/closing valve 8 and the hot gas is made to sequentially flow into each outdoor heat exchanger 3 through the bypass pipeline 10 for defrosting so as to perform defrosting, the defrosting operation can be performed while the heating only operation and the heating-main operation are continued even if there is only one outdoor unit 51. Thus, while the defrosting operation is performed, a comfortable room temperature environment can be maintained without stopping cooling/heating on the indoor unit 53 side. And since there is only one outdoor unit 51, a cost can be kept low. Also, an installation space can be made small. At this time, since the heat amount of condensation of the high-temperature and high-pressure gas refrigerant supplied to the heat exchanger to be defrosted can be used as heat that melts frost by the defrosting operation even during the heating only operation or the heating-main operation, the defrosting operation can be completed efficiently in a short time. Therefore, energy can be saved, and comfort can be improved.

Embodiment 3

Figure 16:
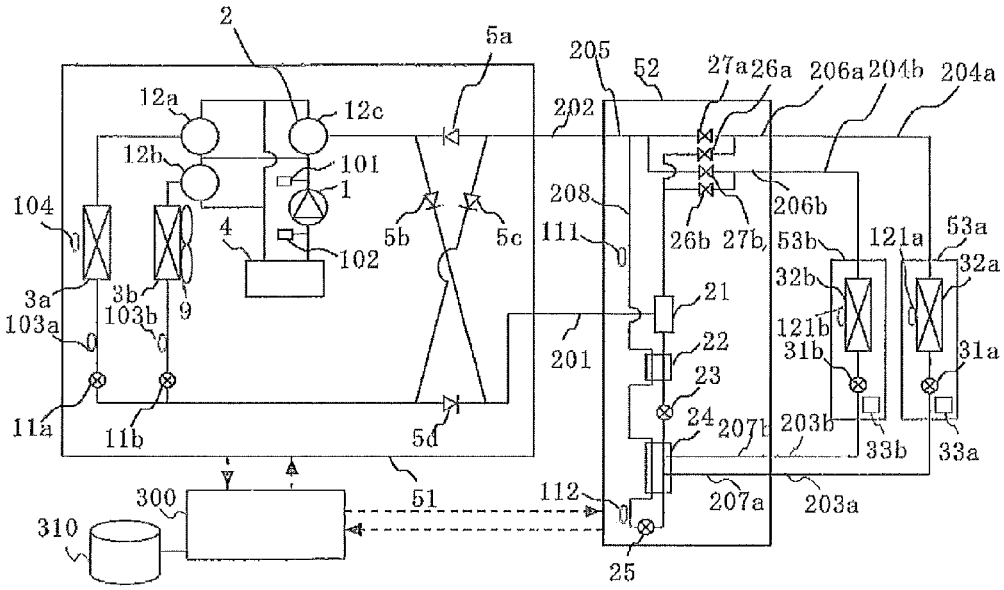
FIG. 16 is a diagram illustrating a configuration of an air conditioner and a refrigerant circuit according to Embodiment 3.

FIG. 16 is a diagram illustrating a configuration of an air conditioner according to Embodiment 3 of the present invention. In FIG. 16, means and the like with the same reference numerals as in FIGS. 1, 8 and the like perform the similar operations as described in Embodiments 1 and 2. In FIG. 16, three way valves 12 (12*a*, 12*b*, 12*c*) switch the valves on the basis of the instruction of the control means 300 so that the path of the refrigerant is switched. In this embodiment, the three-way valves 12*a* and 12*b* that work as second channel switching means make switching between a channel between the outdoor heat exchangers 3*a* and 3*b* and the discharge side of the compressor 1 (hereinafter referred to as a high-pressure side channel) and a channel between the outdoor heat exchangers 3*a* and 3*b* and the accumulator 4 (hereinafter referred to as a low-pressure side channel). The three-way valve 12*c* which works first channel switching means makes switching between a channel between a portion where a pipeline in which the first check valve block 5*a* is disposed and a pipeline in which the second check valve block 5*b* is disposed are connected and the discharge side of the compressor 1 and a channel between a portion where the pipeline in which the first check valve block 5*a* is disposed and pipeline in which the second check valve block 5*b* is disposed are connected and the suction side of the compressor 1 instead of the four-way valve 2 described in Embodiments 1 and 2.

Figure 17:
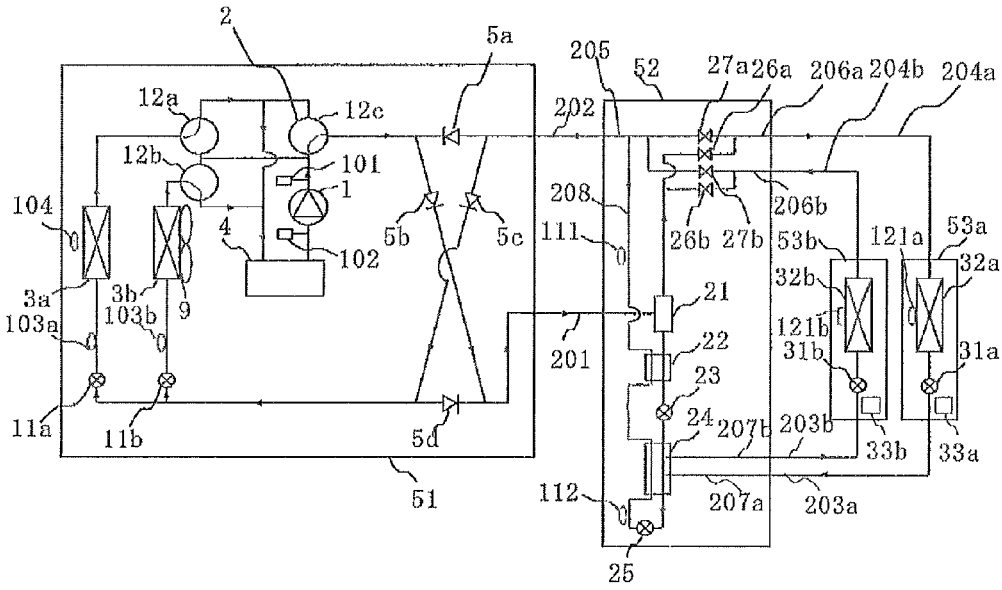
FIG. 17 is a diagram illustrating a flow of a refrigerant of a heating only operation according to Embodiment 3.

FIG. 17 is a diagram illustrating the flow of the refrigerant of the heating-main operation according to Embodiment 3. The air conditioner of this embodiment will be described mainly on the flow of the refrigerant in the outdoor unit 51 during the heating only operation and the heating-main operation.

In the outdoor unit 51, the compressor 1 compresses the sucked refrigerant and discharges the high-pressure gas refrigerant. The refrigerant discharged from the compressor 1 flows through the three-way valve 12*c* and the second check valve block 5*b* and further passes through the high-pressure pipe 201 and flows into the divided-flow controller 52.

In the divided-flow controller 52, on the basis of the instruction of the control means 300, the divided-flow-side opening/closing valves 26*a* and 27*b* are opened, while the divided-flow-side opening/closing valves 27*a* and 26*b* are left closed. The gas refrigerant having flowed into the divided-flow controller 52 passes through the gas-liquid separator 21, the divided-flow-side opening/closing valve 26*a* and the gas pipes 206*a* and 204*a* and flows into the indoor unit 53*a*.

In the indoor unit 53*a*, by means of the opening-degree adjustment of the indoor throttle device 31*a*, the pressure of the refrigerant flowing through the indoor heat exchanger 32*a* is adjusted. Then, the high-pressure gas refrigerant is condensed by heat exchange while passing through the indoor heat exchangers 32*a*, 32*b*, and 32*c*, becomes a liquid refrigerant and passes through the indoor throttle devices 31*a* and 31*b*. At this time, the indoor air is heated by heat exchange so as to heat the space to be air-conditioned (room inside).

The refrigerant having passed through the indoor throttle device 31*a* becomes a liquid refrigerant with an intermediate pressure, for example, passes through the liquid pipes 203*a* and 207*a* and flows into the second inter-refrigerant heat exchanger 24. Then, a part of the refrigerant flowing through the second inter-refrigerant heat exchanger 24 flows into the indoor unit 53*b* through the liquid pipes 207*b* and 203*b*.

In the indoor unit 53*b*, the indoor throttle device 31*b* adjusts the pressure by means of the opening-degree adjustment. The refrigerant which has become a low-pressure liquid refrigerant or a gas-liquid two-phase refrigerant by means of the opening-degree adjustment of the indoor throttle device 31*b* passes through the indoor heat exchanger 32*b*. While passing through the indoor heat exchanger 32*b*, the refrigerant is evaporated by heat exchange with the indoor air in the space to be air-conditioned. Then, it becomes a low-pressure refrigerant and flows into the gas pipe 204*b*. At this time, the indoor air is cooled by heat exchange so as to cool the room inside. The refrigerant having flowed out of the gas pipe 204*b* further passes through the gas pipe 206*b* and the divided-flow-side opening/closing valve 27*b* and flows to the low-pressure pipes 205 and 202.

On the other hand, the remaining of the refrigerant having flowed to the second inter-refrigerant heat exchanger 24 passes through the divided-flow-side second throttle device 25. The refrigerant which has passed through the divided-flow-side second throttle device 25 and has been decompressed, overcools the refrigerant with the intermediate pressure having passed through the liquid pipes 203*a* and 207*a*, while being partially evaporated, flows from the divided-flow-side bypass pipeline 208 to the low-pressure pipes 205 and 202 and flows into the outdoor unit 51.

The refrigerant having flowed into the outdoor unit 51 passes through the third check valve block 5*c* of the outdoor unit 51 and the outdoor throttle device 9 and flows into the outdoor heat exchanger 3. While passing through the outdoor heat exchanger 3, it is evaporated by heat exchange with air and becomes a gas refrigerant. Then, it passes through the three-way valves 12*a* and 12*b* and the accumulator 4, returns to the compressor 1 again and is discharged.

Figure 18:
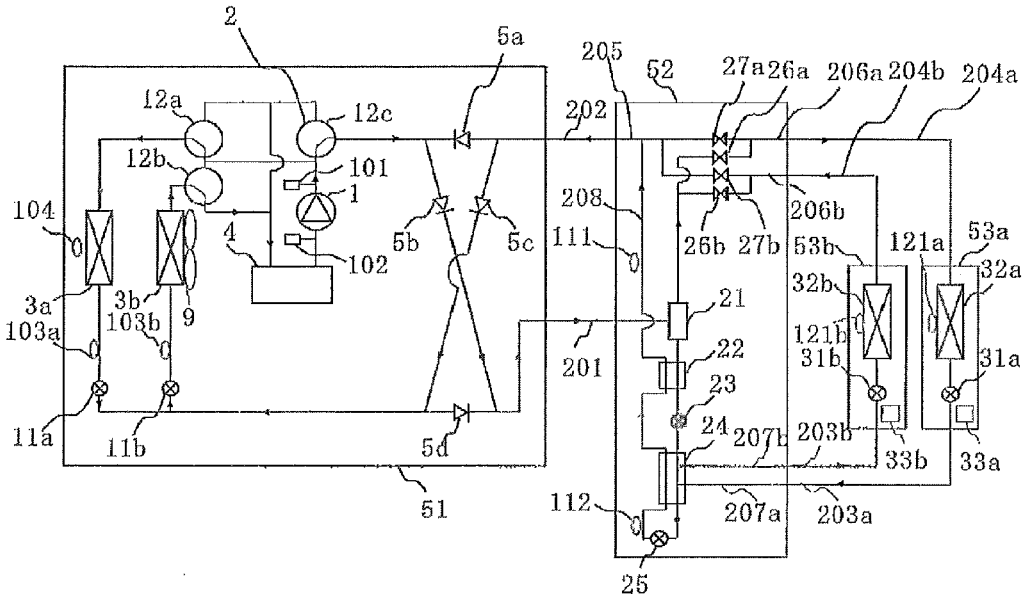
FIG. 18 is a diagram illustrating the flow of the refrigerant during defrosting of a heating-main operation according to Embodiment 3.
Figure 19:
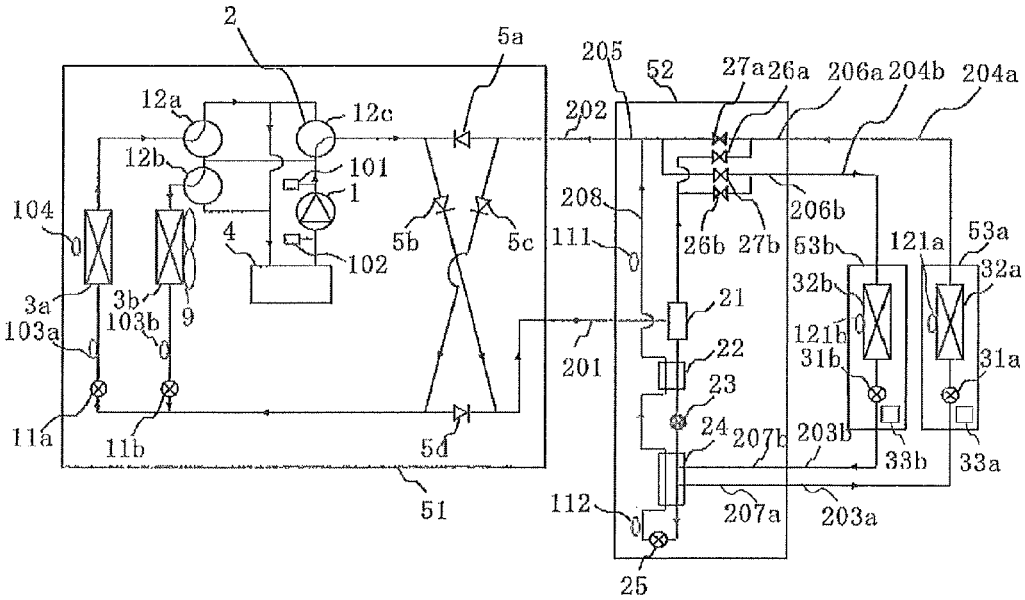
FIG. 19 is a diagram illustrating another flow of the refrigerant during defrosting of the heating-main operation according to Embodiment 3.

FIGS. 18 and 19 are diagrams illustrating the flow of the refrigerant when the defrosting operation is performed in the air conditioner of Embodiment 3. FIG. 18 illustrates the flow of the refrigerant when the defrosting of the outdoor heat exchanger 3*a* is performed during the heating-main operation. FIG. 19 illustrates the flow of the refrigerant when the defrosting of the outdoor heat exchanger 3*b* is performed during the heating-main operation. Here, the heating-main operation will be described, but the same applies to the heating only operation. The flow of the refrigerant in the refrigerant circuit of the heating-main operation is basically the same as the one described using FIG. 17.

After the heating-main operation is continued for a predetermined time, if the control means 300 determines that the defrosting operation is to be performed, the control means makes the three-way valve 12*a* switched to the high-pressure side channel. Also, the outdoor throttle device 11*a* is set at an opening degree for defrosting determined in advance. Also, as described in Embodiment 1, for example, on the basis of the heat exchange amount to be heat-exchanged in the outdoor heat exchanger 3*b*, the outdoor throttle device 11*b* is set at a predetermined opening degree (hereinafter referred to as an opening degree for heating).

As shown in FIG. 18, a part of the high-temperature and high-pressure gas refrigerant discharged from the compressor 1 flows into the outdoor heat exchanger 3*a* through the bypass pipeline 10 for defrosting and the three-way valve 12*a*. By means of heat exchange between the high-temperature gas refrigerant and frost, the frost formed on the outdoor heat exchanger 3*a* is melted, and the refrigerant is condensed and liquefied. The liquid refrigerant passes through the outdoor throttle device 11*a*. Then, it merges with the gas-liquid two-phase refrigerant having passed through the low-pressure pipe 202 and the third check valve block 5*c*, flows only into the outdoor heat exchanger 3*b* through the outdoor throttle device 11*b* and is evaporated/vaporized. Then, it returns to the compressor 1 through the three-way valve 12*b* and the accumulator 4.

Also, if it is determined that the defrosting of the outdoor heat exchanger 3*a* is finished, the control means 300 makes the three-way valve 12*b* switched to the high-pressure side channel. Also, the outdoor throttle device 11*b* is set at an opening degree for defrosting determined in advance. And the three-way valve 12*b* is switched to the low-pressure side channel. Also, an the basis of the heat exchange amount to be heat-exchanged in the outdoor heat exchanger 3*a*, the outdoor throttle device 11*a* is set at the opening degree for heating.

As shown in FIG. 19, a part of the high-temperature and high-pressure gas refrigerant discharged from the compressor 1 flows into the outdoor heat exchanger 3*b* through the bypass pipeline 10 for defrosting and the three-way valve 12*b*. By means of heat exchange between the high-temperature gas refrigerant and frost, the frost formed on the outdoor heat exchanger 3*b* is melted, and the refrigerant is condensed and liquefied. The liquid refrigerant passes through the outdoor throttle device 11*b*. Then, it merges with the gas-liquid two-phase refrigerant having passed through the low-pressure pipe 202 and the third check valve block 5*c*, flows only into the outdoor heat exchanger 3*a* through the outdoor throttle device 11*a* and is evaporated/vaporized. Then, it returns to the compressor 1 through the three-way valve 12*a* and the accumulator 4.

Figure 20:
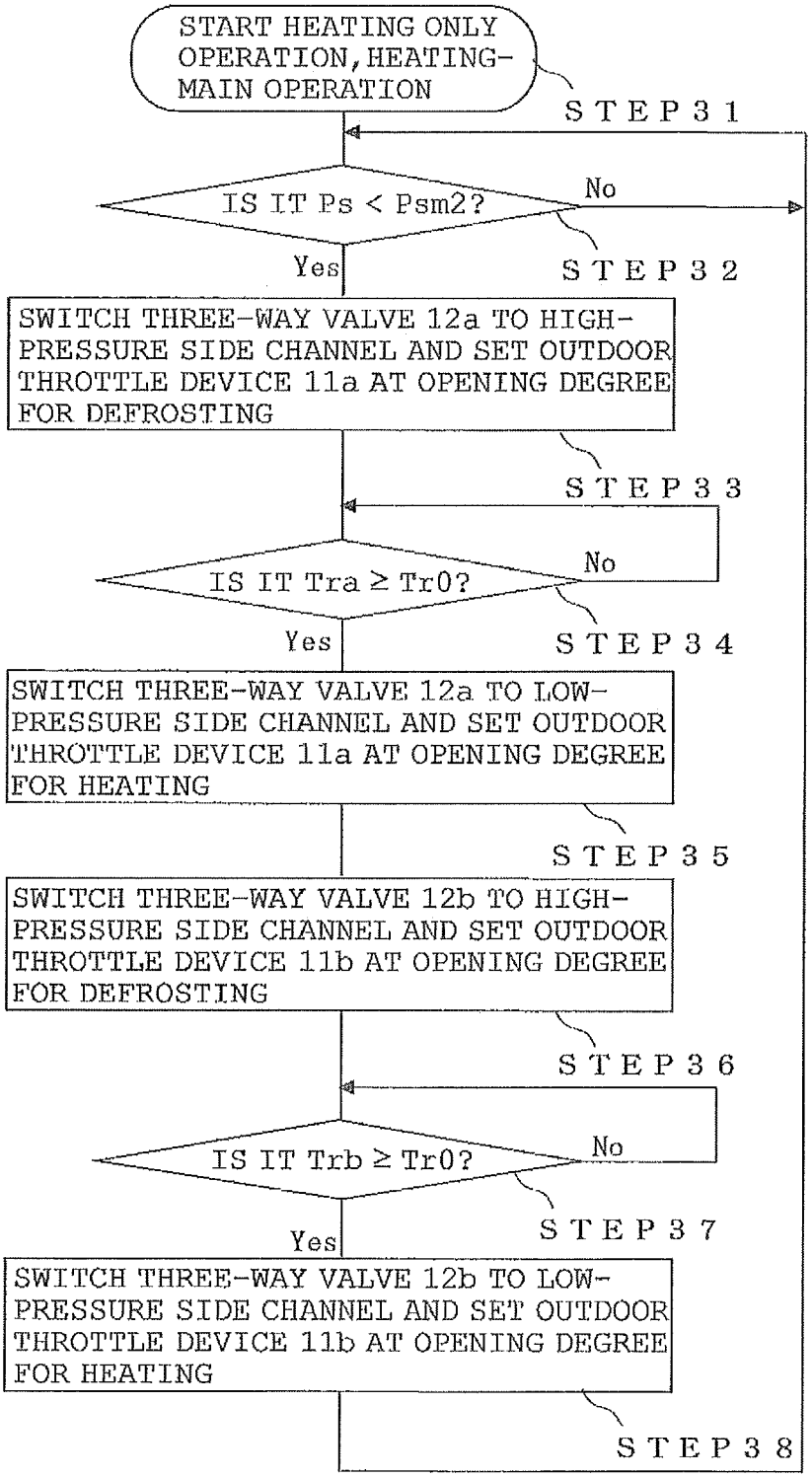
FIG. 20 is a diagram illustrating a flowchart according to a defrosting operation in Embodiment 3.

FIG. 20 is a diagram illustrating a flowchart according to the defrosting operation performed by the control means 300 in Embodiment 3. When the heating only operation or heating-main operation by the air conditioner is started (STEP 31), it is determined whether the value of the low pressure Ps on the basis of the signal from the second pressure sensor 102 mounted on the suction side of the compressor 1 is lower than a low-pressure target value Psm2 or not (STEP 32). If it is determined that the value of the low pressure Ps is lower than the target value Psm2, the three-way valve 12*a* is switched to the high-pressure side channel, the outdoor throttle device 11*a* is set at the opening degree for defrosting, and the defrosting of the outdoor heat exchanger 3*a* is started as described above (STEP 33). Then, it is determined if the temperature Tra on the basis of the signal from the temperature sensor 103*a* is at the predetermined value Tr0 or more (STEP 34). And until it is determined that the temperature Tra is at the predetermined value Tr0 or more, defrosting of the outdoor heat exchanger 3*a* is continued.

If it is determined that the temperature Tra is at the predetermined value Tr0 or more, the three-way valve 10*a* is switched to the low-pressure side channel, and the outdoor throttle device 11*a* is set at the opening degree for heating (STEP 35). Also, after a predetermined time has elapsed, the three-way valve 10*b* is switched to the high-pressure side channel, and the outdoor throttle device 11*b* is set at the opening degree for defrosting (STEP 36). Then, it is determined if a temperature Trb on the basis of the signal from the temperature sensor 103*b* is at the predetermined value Tr0 or more (STEP 37). Then, defrosting of the outdoor heat exchanger 3*b* is continued until it is determined that the temperature Trb is at the predetermined value Tr0 or more.

If it is determined that the temperature Trb is at the predetermined value Tr0 or more, the three-way valve 10*b* is switched to the low-pressure side channel, and the outdoor throttle device 11*b* is set at the opening degree for heating (STEP 38). Then, the routine returns to STEP 32 and continues processing.

As described above, according to the air conditioner of Embodiment 3, since the plurality of outdoor heat exchangers 3 are connected in parallel to the outdoor unit 51 by a pipeline, the control means 300 controls switching of the three-way valves 12*a* and 12*b* and opening/closing of the bypass opening/closing valve 8 and the hot gas is made to sequentially flow into each outdoor heat exchanger 3 through the bypass pipeline 10 for defrosting so as to perform defrosting, the defrosting operation can be performed while the heating only operation and the heating-main operation are continued even if there is only one outdoor unit 51. Thus, while the defrosting operation is performed, a comfortable room temperature environment can be maintained without stopping cooling/heating on the indoor unit 53 side. And since there is only one outdoor unit 51, a cost can be kept low. Also, an installation space can be made small. At this time, the heat amount of condensation of the high-temperature and high-pressure gas refrigerant supplied to the outdoor heat exchanger 3 to be defrosted can be used as heat that melts frost by the defrosting operation even during the heating only operation or the heating-main operation, and the defrosting operation can be completed efficiently in a short time. Therefore, energy can be saved, and comfort can be improved. Also, since the number of valves can be decreased by using the three-way valves 12*a* and 12*b*, the circuit can be simplified. Also, since a pressure loss in the valve can be reduced, efficiency can be improved.

Embodiment 4

In the above-described Embodiment 1, the control means 300 controls the second channel opening/closing valve 7 and the bypass opening/closing valve 8 in conjunction and makes switching of the refrigerant flowing into the outdoor heat exchanger 3 between the refrigerant from the bypass pipeline 10 for defrosting and the refrigerant from the indoor unit 53 (divided-flow controller) side, but not limited to that. For example, the refrigerant may be switched using the three way valve similar to that in Embodiment 3 instead of the second channel opening/closing valve 7 and the bypass opening/closing valve 8.

Embodiment 5

In the air conditioner of each of the above embodiments, the two outdoor heat exchangers 3, that is, the heat exchanger 3*a* and the outdoor heat exchanger 3*b* are configured in parallel, but the similar effect can be obtained by three or more heat exchangers. Also, the performances relating to heat exchange of each outdoor heat exchanger 3 may be the same or may be different. Also, in FIG. 1 and the like, the first channel opening/closing valve 6, the second channel opening/closing valve 7, the bypass opening/closing valve 8, and the outdoor throttle device 11 that control inflow/outflow and the like of the refrigerant of the outdoor heat exchanger 3 are installed one each, but the number is not limited. Also, if the heat amount relating to heat exchange is small or the like, the inflow/outflow of the refrigerant to/from each outdoor heat exchanger 3 may be controlled by switching open/closed states of the valve.

Embodiment 6

In the above-described embodiments, the air conditioner capable of cooling/heating simultaneous operation has been described but the present invention is not limited to that. For example, the present invention can be applied also to an air conditioner with a refrigerant circuit configuration not performing the cooling-main operation or heating-main operation. Also, the present invention can be applied also to a heating device that heats a target space and the like.

The invention claimed is:

1. An air conditioner, comprising:

an outdoor unit having a compressor that pressurizes and discharges a refrigerant, a plurality of outdoor heat exchangers that exchange heat between outside air and the refrigerant, and first channel switching means that switches a channel on the basis of an operation form;

a plurality of indoor units, each having an indoor heat exchanger that exchanges heat between air in a space to be air-conditioned and the refrigerant and indoor flow-rate control means, both being connected by a pipeline so as to constitute a refrigerant circuit, wherein a bypass pipeline that divides the refrigerant discharged from said compressor and allows each refrigerant to flow into each of the outdoor heat exchangers connected in parallel and a plurality of second channel switching means, each performing switching such that either the refrigerant having passed through the bypass pipeline or the refrigerant from said indoor units is made to flow into each of said outdoor heat exchangers are provided in said outdoor unit;

a pressure detecting sensor that detects pressure on a suction side of the compressor; and a controller configured to sequentially control switching of each second channel switching means during a heating operation when it is detected that the pressure on the suction side of the compressor is lower than a predetermined pressure to allow the refrigerant having passed through said bypass pipeline without having passed through an indoor unit of the plurality of indoor units to flow into at least one outdoor heat exchanger of the plurality of outdoor heat exchangers so as to defrost the at least one outdoor heat exchanger and to simultaneously allow the refrigerant having passed through said indoor units without having passed through the bypass pipeline to flow into at least one other outdoor heat exchanger of the plurality of outdoor heat exchangers and then after a predetermined time has elapsed to allow the refrigerant having passed through said bypass pipeline without having passed through an indoor unit of the plurality of indoor units to flow into at least one other outdoor heat exchanger of the plurality of outdoor heat exchangers and to simultaneously allow the refrigerant having passed through said indoor units without having passed through the bypass pipeline to flow into the at least one outdoor heat exchanger.

2. The air conditioner of claim 1, further comprising:

a pressure detecting sensor that detects pressures on a discharge side of said compressor; and the controller is configured to determine the discharge amount of the refrigerant by said compressor and a total heat exchange amount in said plurality of outdoor heat exchangers on the basis of values of the pressures on the discharge side and the suction side of the compressor relating to detection of said pressure detecting sensor so that the pressures on the discharge side and the suction side of said compressor become target values, respectively.

3. The air conditioner of claim 1, wherein the controller is configured to stop inflow of the refrigerant into the indoor heat exchanger of the corresponding indoor unit if a temperature of the refrigerant flowing through the indoor heat exchanger in each indoor unit is determined to be at a predetermined temperature or less for a predetermined time or more.

4. The air conditioner of claim 1, wherein an opening degree controllable throttle device is disposed at a position to be an inlet of the outdoor heat exchanger when heating.

5. The air conditioner of claim 4, wherein an opening degree of said throttle device is set at an opening degree for defrosting.

6. The air conditioner of claim 1, wherein the bypass pipeline is branched between an outlet of the compressor and an inlet of the first channel switching means.

* * * * *